US008301070B2

(12) United States Patent
Matsumoto

(10) Patent No.: US 8,301,070 B2
(45) Date of Patent: Oct. 30, 2012

(54) BELT CONVEYING APPARATUS AND IMAGE FORMING APPARATUS

(75) Inventor: Keigo Matsumoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 963 days.

(21) Appl. No.: 12/216,038

(22) Filed: Jun. 27, 2008

(65) Prior Publication Data

US 2009/0003871 A1 Jan. 1, 2009

(30) Foreign Application Priority Data

Jun. 28, 2007 (JP) ..... 2007-170451

(51) Int. Cl.
*G03G 21/00* (2006.01)

(52) U.S. Cl. ..... 399/346; 399/350; 399/351; 399/358; 399/360; 430/119.82; 430/119.86

(58) Field of Classification Search ..... 399/101, 399/346, 351, 360; 430/119.82, 119.84, 430/119.86
See application file for complete search history.

(56) References Cited

U.S. PATENT DOCUMENTS

| | | | | |
|---|---|---|---|---|
| 4,690,544 | A * | 9/1987 | Forbes et al. | 399/164 |
| 4,786,937 | A * | 11/1988 | Bouwens | 399/111 |
| 5,349,429 | A * | 9/1994 | Jugle et al. | 399/346 |
| 5,530,537 | A * | 6/1996 | Thayer | 399/357 |
| 5,991,568 | A * | 11/1999 | Ziegelmuller et al. | 399/102 |
| 7,016,639 | B2 * | 3/2006 | Park et al. | 399/350 |
| 7,127,201 | B2 * | 10/2006 | Takenouchi et al. | 399/297 |
| 7,139,504 | B2 * | 11/2006 | Yanagida et al. | 399/100 |
| 7,177,582 | B2 * | 2/2007 | Ohta et al. | 399/350 |
| 7,266,324 | B2 * | 9/2007 | Yanagida et al. | 399/100 |
| 7,302,203 | B2 * | 11/2007 | Morimoto et al. | 399/101 |
| 7,313,343 | B2 * | 12/2007 | Tanaka et al. | 399/101 |
| 7,313,356 | B2 * | 12/2007 | Koyama | 399/349 |
| 7,398,046 | B2 * | 7/2008 | Kojima | 399/350 |
| 7,792,454 | B2 * | 9/2010 | Nishisaka et al. | 399/71 |
| 8,131,170 | B2 * | 3/2012 | Kurz | 399/35 |
| 8,170,457 | B2 * | 5/2012 | Aoyama et al. | 399/327 |
| 8,204,423 | B2 * | 6/2012 | Hatori et al. | 399/346 |
| 2005/0220513 | A1 * | 10/2005 | Curynski et al. | 399/346 |
| 2006/0034632 | A1 * | 2/2006 | Takada et al. | 399/101 |
| 2007/0036569 | A1 * | 2/2007 | Taguchi et al. | 399/49 |
| 2009/0148177 | A1 * | 6/2009 | Nishisaka et al. | 399/71 |

(Continued)

FOREIGN PATENT DOCUMENTS

JP 1-161288 6/1989

(Continued)

OTHER PUBLICATIONS

English machine translation of Funabashi (JP 2005173351 A).*

(Continued)

*Primary Examiner* — David Gray
*Assistant Examiner* — Geoffrey Evans
(74) *Attorney, Agent, or Firm* — Rabin & Berdo, P.C.

(57) ABSTRACT

An image forming apparatus includes a belt conveying portion having a movable endless belt provided around at least two supporting members, a cleaning member provided in contact with a surface of the belt, a lubricant supply portion provided below a contact portion between the belt and the cleaning member for supplying lubricant to the contact portion, and an adhered-material storing portion provided below the lubricant supply portion for storing adhered-material scraped off from the belt by the cleaning member.

24 Claims, 14 Drawing Sheets

U.S. PATENT DOCUMENTS

| | | | | |
|---|---|---|---|---|
| 2009/0245904 | A1* | 10/2009 | Maruyama | 399/350 |
| 2009/0257797 | A1* | 10/2009 | Arai et al. | 399/350 |
| 2011/0044718 | A1* | 2/2011 | Tanaka et al. | 399/101 |
| 2011/0206430 | A1* | 8/2011 | Arai et al. | 399/346 |
| 2011/0229187 | A1* | 9/2011 | Hozumi et al. | 399/101 |
| 2012/0020693 | A1* | 1/2012 | Yamaki et al. | 399/71 |

FOREIGN PATENT DOCUMENTS

| | | | |
|---|---|---|---|
| JP | 7-319359 | | 12/1995 |
| JP | 2001-42726 | | 2/2001 |
| JP | 2001-282010 | | 10/2001 |
| JP | 2002-323837 | | 11/2002 |
| JP | 2004-077607 | | 3/2004 |
| JP | 2005173351 | A * | 6/2005 |
| JP | 2006-53213 | | 2/2006 |
| JP | 2011043598 | A * | 3/2011 |
| JP | 2011248167 | A * | 12/2011 |

OTHER PUBLICATIONS

English machine translation of Tanaka et al. (JP 2011043598 A).*

* cited by examiner

BELT CONVEYING APPARATUS AND IMAGE FORMING APPARATUS

BACKGROUND OF THE INVENTION

This invention relates to a belt conveying apparatus and an image forming apparatus having a cleaning apparatus for cleaning a surface of a transfer belt of a transfer portion for transferring a toner image.

Recently, a color image forming apparatus such as a color copier has been developed according to colorization of office documents or the like. Further, there is known a four-drum-type image forming apparatus which includes four photosensitive drums (as image bearing bodies) arranged parallel to each other. Such an image forming apparatus is configured to form toner images on the respective photosensitive drums using toners (as developers) of, for example, yellow, magenta, cyan and black. The respective toner images are transferred to a sheet conveyed by a transfer belt (an endless belt) of a transfer portion so that toner images of respective colors are superimposed with each other. Conventionally, the transfer portion of the image forming apparatus has a cleaning blade formed of urethane rubber or the like for removing a toner adhering to a surface of the transfer belt. Such a conventional image forming apparatus is disclosed in, for example, Japanese Laid-Open Patent Publication No. 2004-77607 (paragraphs 0025-0033 and FIG. 10).

SUMMARY OF THE INVENTION

The present invention is intended to provide an image forming apparatus and a belt conveying apparatus capable of stably removing toner adhering to a belt.

The present invention provides an image forming apparatus including a belt conveying portion having a movable endless belt provided around at least two supporting members, a cleaning member provided in contact with a surface of the belt, a lubricant supply portion provided below a contact portion between the belt and the cleaning member, the lubricant supply portion supplying lubricant to the contact portion, and an adhered-material storing portion provided below the lubricant supply portion. The adhered-material storing portion stores adhered-material scraped off from the belt by the cleaning member.

The present invention also provides an image forming apparatus including a toner adhesion member to which a toner adheres, the toner adhesion member causing the toner to move, a cleaning member provided in contact with a surface of the toner adhesion member, a toner accumulation member disposed below a contact portion between the toner adhesion member and the cleaning member so that a part of the toner scraped off from the cleaning member is accumulated on the toner accumulation member, and a toner storing portion provided below the toner accumulation member. The toner storing portion stores the toner scraped off by the cleaning member. The toner accumulated on the toner accumulation member is supplied to the contact portion as lubricant.

The present invention also provides a belt conveying apparatus for conveying recording medium. The belt conveying apparatus includes a belt conveying portion having a movable endless belt provided around at least two supporting members, a cleaning member provided in contact with a surface of the belt, a lubricant supply portion provided below a contact portion between the belt and the cleaning member, the lubricant supply portion supplying lubricant to the contact portion, and an adhered-material storing portion provided below the lubricant supply portion. The adhered-material storing portion stores the adhered-material scraped off from the belt by the cleaning member.

With such an arrangement, when the cleaning blade contacting the belt removes the adhered-material from the belt, any increase of the contact friction can be restricted, and removal of the adhered-material from the belt can be stably performed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, an embodiment of the present invention will be described with reference to the attached drawings.

Embodiment 1

Figure 1:
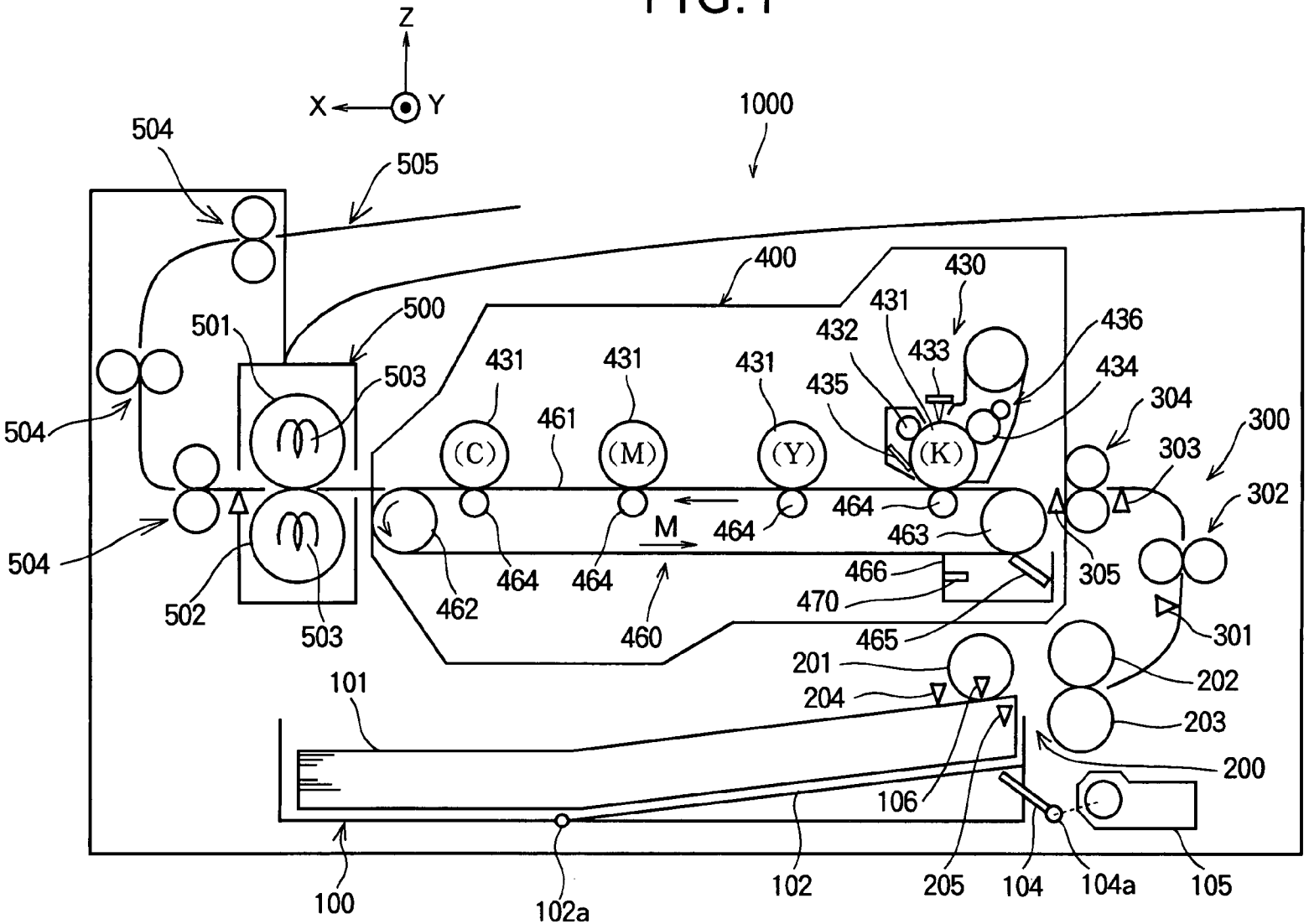
FIG. 1 is a schematic view showing a configuration of an image forming apparatus according to Embodiment 1 of the present invention.

FIG. 1 is a schematic view showing a configuration of an image forming apparatus according to Embodiment 1 of the present invention.

The image forming apparatus 1000 shown in FIG. 1 has a configuration of, for example, an electrophotographic color printer. In FIG. 1, a sheet tray 100 is detachably mounted to a main body of the image forming apparatus 1000. Recording sheets (i.e., recording medium) 101 are stacked in the sheet tray 100. The sheet tray 100 has a sheet placing plate 102 on which the recording sheets 101 are placed, and the sheet placing plate 102 is rotatably supported by a supporting shaft 102*a*. The sheet tray 100 is provided with not shown guide members for defining a position of the recording sheets 101 stacked on the sheet placing plate 102. The guide members define ends of the stack of the recording sheets 101 in the sheet feeding direction and in the direction perpendicular to the sheet feeding direction, so as to maintain the constant position of the stack of the recording sheet.

A lift-up lever 104 is rotatably supported by a shaft 104*a* provided on the sheet feeding side of the sheet tray 100. The shaft 104*a* is disengageably connected to a motor 105. When the sheet tray 100 is mounted to the main body of the image forming apparatus 1000, the lift-up lever 104 is connected to the motor 105, and a not shown controller drives the motor 105. When the lift-up lever 104 is rotated, the tip of the lift-up lever 104 pushes the bottom of the sheet placing plate 102 upward, and the recording sheets 101 placed on the sheet placing plate 102 moves upward. When the recording sheets 101 reach a predetermined height, an upward movement detecting portion 106 detects the recording sheets 101, and the not shown controller stops the motor 105 based on the detection signal from the upward movement detecting portion 106.

A sheet feeding portion 200 is disposed on the sheet feeding side of the sheet tray 100, for individually feeding the recording sheet 101. The sheet feeding portion 200 includes a pickup roller 201 provided so as to contact the recording sheet 101 having moved upward to a predetermined height, and a pair of rollers (i.e., a feed roller 202 and a retard roller 203) for separating the uppermost recording sheet 101 from next recording sheet 101 picked up by the pickup roller 201. The sheet feeding portion 200 further includes a sheet existence detecting portion 204 that detects the existence of the recording sheets 101 and a sheet remaining amount detecting portion 205 that detects the remaining amount of the recording sheets 101.

The recording sheet 101 having been separated (from subsequent recording sheets) and fed by the sheet feeding portion 200 reaches a sheet conveying portion 300. In the sheet conveying portion 300, the recording sheet 101 passes a sheet sensor 301 and reaches a pair of sheet conveying rollers 302. The sheet conveying rollers 302 start conveying the recording sheet 101 with a predetermined time delay after the recording sheet 101 is detected by the sheet sensor 301. With this, the recording sheet 101 is pushed into a contact portion of the sheet conveying rollers 302 so that the recording sheet 101 is slightly warped, and therefore the skew of the recording sheet 101 is corrected. The recording sheet 101 is further conveyed by the conveying rollers 302, passes a sheet sensor 303, and reaches a pair of conveying rollers 304. The conveying rollers 304 start rotating by a not shown driving portion when the recording sheet 101 is detected by the sheet sensor 303, and convey the recording sheet 101 without stopping the recording sheet 101. The recording sheet 101 is further conveyed by the conveying rollers 302, passes a writing sensor 305, and reaches an image forming portion 400.

The image forming portion 400 includes four toner image forming portions 430 which are linearly arranged, and a transfer portion 460 that transfer toner images of the image forming portions 430 to an upper surface of the recording sheet 101 by means of Coulomb force. The four toner image forming portions 430 have the same configurations except colors (black (K), yellow (Y), magenta (M) and cyan (C)) of the toner. Therefore, for facilitating description, parts of only the image forming portions 430 of black (K) located at the most upstream position (in the conveying direction of the recording sheet 101) are shown in FIG. 1. Parts of other three image forming portions 430 are omitted in FIG. 1, and only photosensitive drums 431 of the three image forming portions 430 are shown in FIG. 1.

The toner image forming portion 430 includes a photosensitive drum 431 that bears a toner image, a charging roller 432 that uniformly charges the surface of the photosensitive drum 431, an LED head 433 composed of an LED array that forms a latent image on the charged surface of the photosensitive drum 431, a developing roller 434 that develops the latent image by means of frictional electrification to thereby form a toner image, a toner supply portion 436 that supplies the toner to the developing roller 434, a cleaning blade 435 that scrapes off the residual toner remaining on the photosensitive drum 431 after the transferring, and the like.

The transfer portion 460 includes an endless transfer belt 461 (i.e., a toner adhesion member) that carries the recording sheet 101 in a state where the recording sheet 101 adheres to the transfer belt 461 by means of electrostatic force. The transfer portion 460 further includes a drive roller 462 rotated by a driving portion (not shown) in the direction shown by an arrow to move the transfer belt 461, and a tensioning roller 463 pairing with the driving roller 462 so that the transfer belt 461 is wound around the driving roller 462 and the tensioning roller 463. The transfer belt 461, the driving roller 462 and the tensioning roller 463 constitute a belt conveying portion. The transfer portion 460 further includes transfer rollers 464 facing and urged against the photosensitive drums 431 of the toner image forming portion 430, and applied with voltages so that toner images are transferred from the photosensitive drums 431 to the recording sheet 101. The transfer portion 460 further includes a cleaning blade 465 as a cleaning member that scrapes off the toner (adhered-material) adhering to the surface of the transfer belt 461, and a toner box 466 as a toner storing portion (or an adhered-material storing portion) in which the toner scraped off from the transfer belt 461 is accumulated.

The toner image forming portion 430 and the transfer belt 461 are driven in synchronization with each other, and the toner images of the respective colors are transferred successively to the recording sheet 101 fed by the transfer belt 461 (in a state where the recording sheet 101 adheres to the transfer belt 461 with electrostatic force) so that the images of the respective colors are superimposed with each other. The recording sheet 101 with the toner having been transferred by the image forming portion 400 is fed to a fixing unit 500 for fixing the toner image to the recording sheet 101 with heat and pressure.

The fixing unit 500 includes an upper roller 501 and a lower roller 502. Each of the upper roller 501 and the lower roller 502 has a halogen lamp 503 as an internal heat source and a surface layer formed of a resilient member. The upper roller 501 and the lower roller 502 apply heat and pressure to the toner image formed on the recording sheet 101 fed from the image forming portion 400 to thereby fix the toner image to the recording sheet 101. Thereafter, the recording sheet 101 is ejected by a pair of ejection rollers 504 to a stacker portion 505.

In FIG. 1, XYZ coordinate is determined as follows. X-axis is defined in the conveying direction of the recording sheet 101 when the recording sheet passes the toner image forming portions 430. Y-axis is defined in the direction of rotation axes of the photosensitive drums 431. Z-axis is defined as being perpendicular to both of the X-axis and the Y-axis. In the subsequent drawings, the X-axis, the Y-axis and the Z-axis indicate the same directions as those shown in FIG. 1. That is, in the subsequent drawings, the X-axis, the Y-axis and the Z-axis indicate directions of component parts in a state where the component parts are assembled into the image forming apparatus 1000 shown in FIG. 1.

Figure 2:
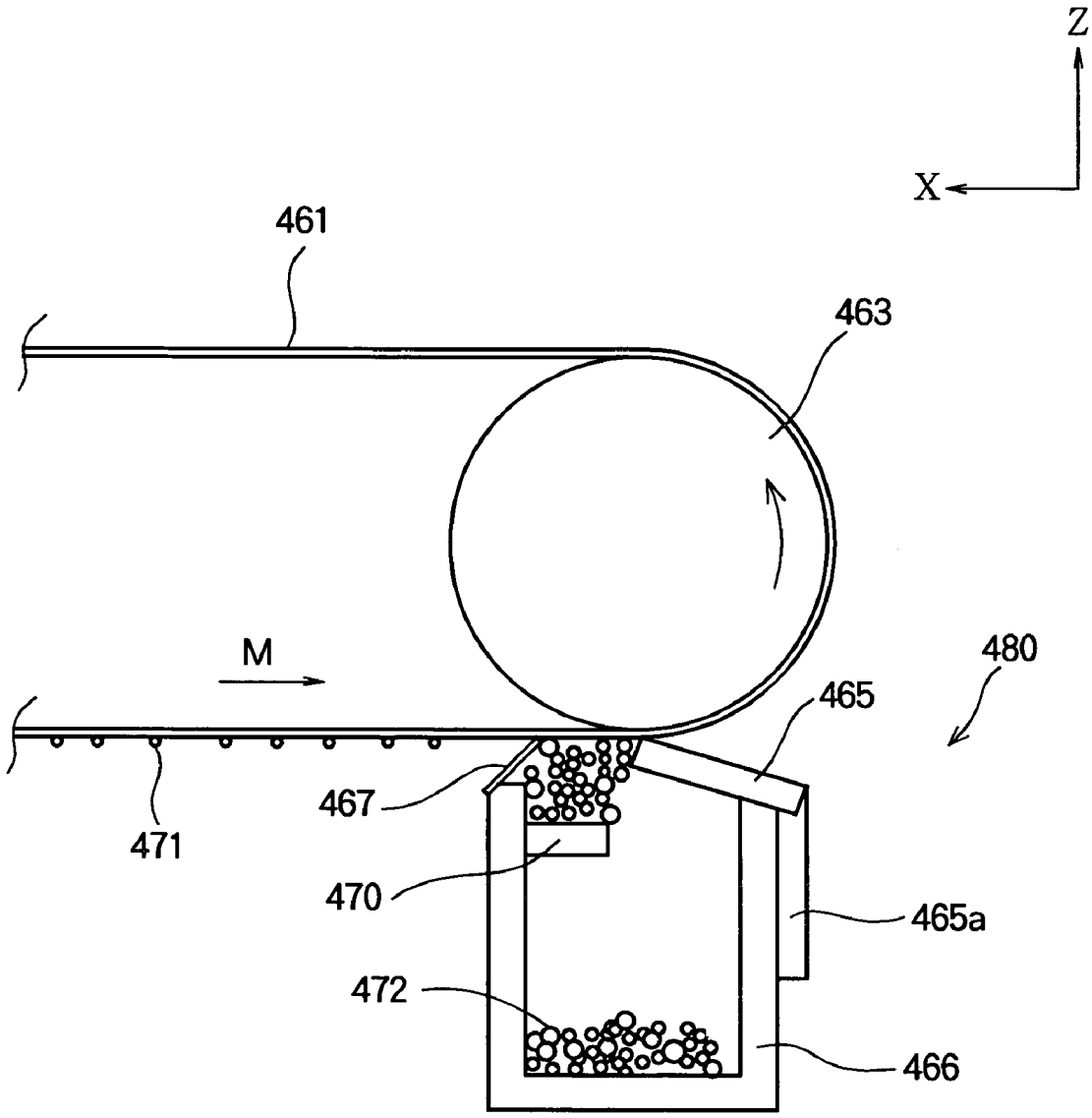
FIG. 2 is an enlarged view showing a cleaning apparatus including a cleaning blade and a toner box shown in FIG. 1 and surroundings thereof.

As shown in FIG. 2, the cleaning apparatus 480 includes the cleaning blade 465, the toner box 466, a film 467, and a toner accumulation member 470 as a lubricant supply portion. The cleaning blade 465 extends in the width direction of the transfer belt 461. The cleaning blade 465 is attached to the toner box 465 by means of a cleaning blade attachment metal plate 465*a* in such a manner that the cleaning blade 465 is pressed against the transfer belt 461, with the transfer belt 461 being sandwiched by the tensioning roller 463 and the cleaning blade 465. A toner as lubricant is preliminarily coated on the tip of the cleaning blade 465 so that the transfer belt 461 moves smoothly. The film 467 is composed of a resilient member. The film 467 is attached to the toner box 466 so that the film 467 contacts the transfer belt 461 to thereby prevent the leakage of the waste toner 472 in the toner box 466.

Figure 3:
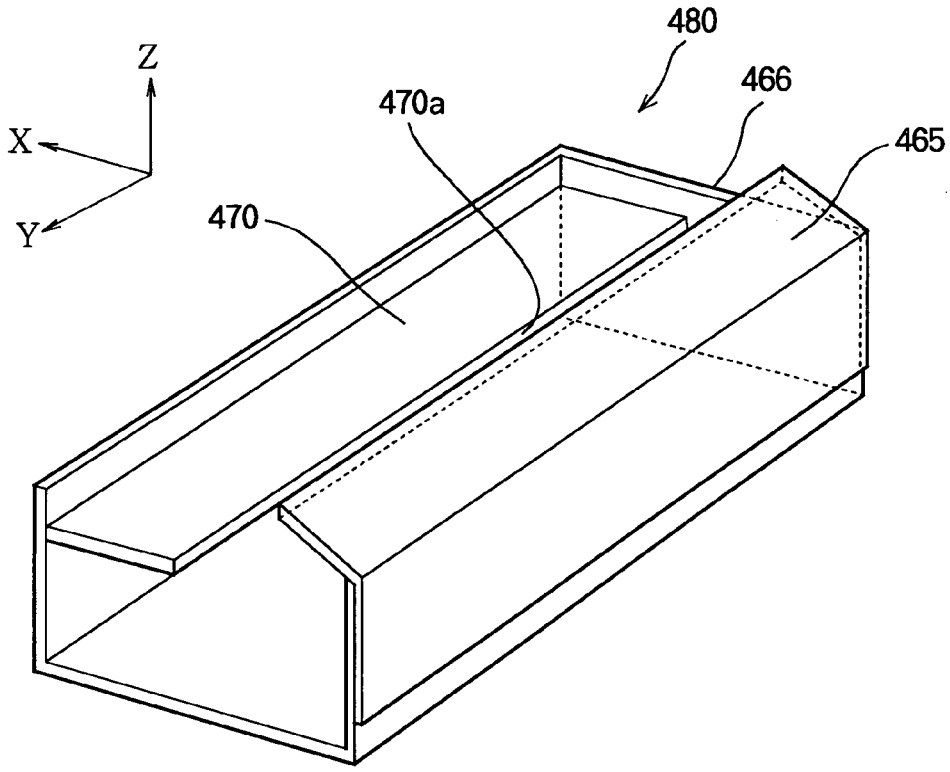
FIG. 3 is a perspective view showing an external configuration of the cleaning apparatus according to Embodiment 1 as obliquely seen from above.
Figure 4:
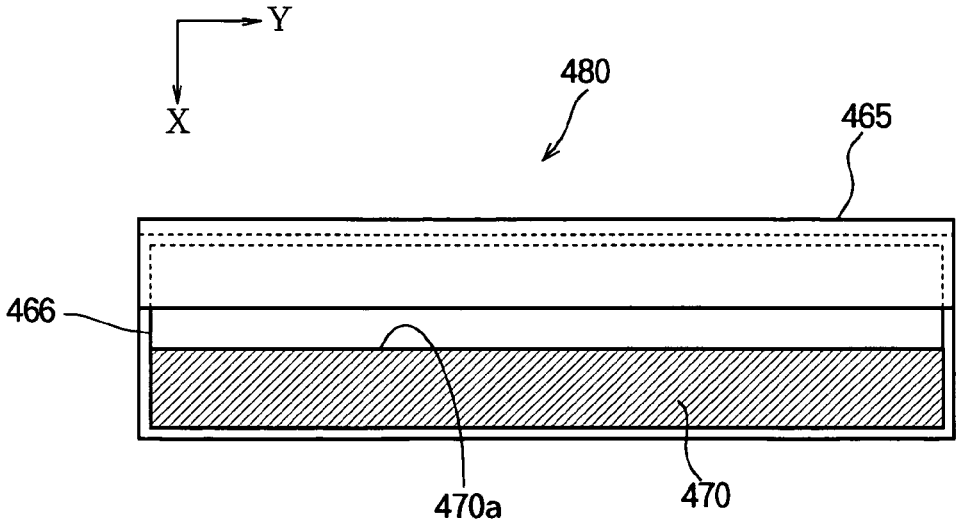
FIG. 4 is a plan view showing the cleaning apparatus according to Embodiment 1.
Figure 5:
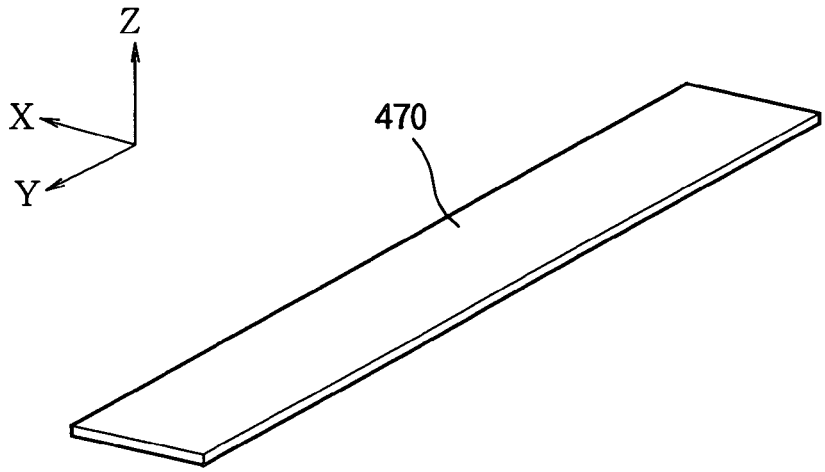
FIG. 5 is a perspective view showing an external form of a toner accumulation member of the cleaning apparatus according to Embodiment 1.
Figure 6:
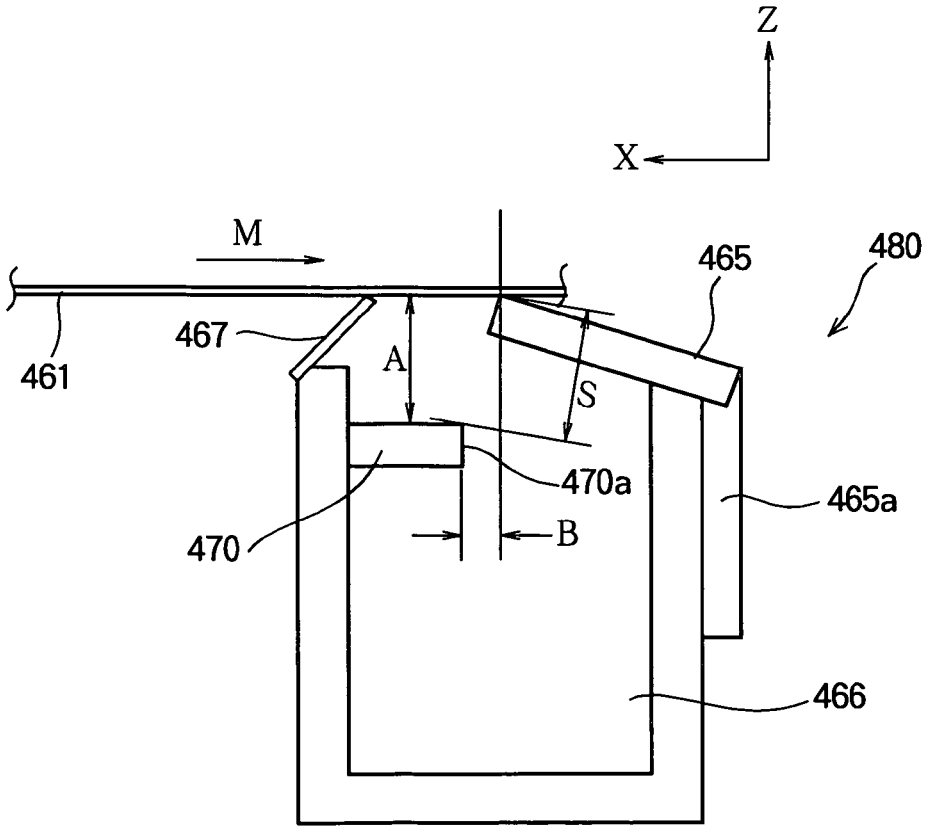
FIG. 6 is a sectional view showing an internal configuration of the cleaning apparatus according to Embodiment 1.

FIG. 3 is a perspective view of the cleaning apparatus 480 as obliquely seen from above. FIG. 4 is a plan view of the cleaning apparatus 480. FIG. 5 is a perspective view showing an external form of the toner accumulation member 470 of the cleaning apparatus 480. FIG. 6 is a sectional view showing an internal configuration of the cleaning apparatus 480. In FIG. 3, near side wall of the toner box 466 is omitted so that the positional relationship between the toner box 466 and the toner accumulation member 470 can be easily seen.

The toner accumulation member 470 is a rectangular and elongated plate-like member as shown in FIG. 3. The toner accumulation member 470 is disposed on the upstream side of the cleaning blade 465 in the moving direction of the transfer belt 461 and is disposed on a position lower than the cleaning blade 465 in the vertical direction. The toner accumulation member 470 is a shelf-like member provided in the toner box 466 so that the toner scraped off from the transfer belt 461 by the cleaning blade 465 is accumulated on the toner accumulation member 470. The toner accumulation member 470 is fixed to the toner box 466 using, for example, thermal welding or the like in order to prevent the disengaging of the toner accumulation member 470 due to the weight of the waste toner 472.

Further, as shown in FIG. 6, a space S is formed between the cleaning blade 465 and the toner accumulation member 470. The space S is determined by distances A and B representing the positional relationship between the cleaning blade 465 and the toner accumulation member 470. An end portion (tip) 470*a* of the toner accumulation member 470 extends parallel to the cleaning blade 465 in the longitudinal direction of the cleaning blade 465. The toner accumulation member 470 is elongated in the width direction of the transfer belt 461, and disposed in parallel to the surface of the transfer belt 461. The distances A and B will be described later.

With the above configured cleaning apparatus 480, the operation of respective parts will be described.

The driving roller 462 is rotated counterclockwise as shown in an arrow in FIG. 1, and the transfer belt 462 moves in a direction shown by an arrow M in FIG. 1 passing through the respective toner image forming portions 430. At the respective image forming 430, the toner images of the respective colors are transferred to the recording sheet 101 from the photosensitive drums 431. The toner 471 remaining on the photosensitive drum 431 without being transferred to the recording sheet 101 adheres to the surface of the transfer belt 461 moving in the direction indicated by the arrow M. As shown in FIG. 2, when the transfer belt 461 moves, the toner 471 adhering to the surface of the transfer belt 461 is scraped off therefrom at a contact portion between the transfer belt 461 and the cleaning blade 465. The scraped-off toner 471 (i.e., waste toner 472) is stored in the toner box 466.

Here, the assumed operation when the toner accumulation member 470 is not provided.

At the transfer portion 460, when the amount of toner 471 adhering to the transfer belt 461 is small (i.e., a minute amount), the cleaning blade 465 is not applied with sufficient amount of the toner 471. In such a case, according to contact of the moving transfer belt 461 and the cleaning blade 465, the amount of the toner (as lubricant) preliminarily coated on the surface of the cleaning blade 465 gradually decreases, so that the friction between the transfer belt 461 and the cleaning blade 465 gradually increases. Due to the increase of the friction, the tip of the cleaning blade 465 may be bent in the moving direction of the transfer belt 461. For example, in the case where the recording sheet of A4 size is fed in the long edge direction, the bending of the tip of the cleaning blade 465 occurs when approximately 2000 recording sheets are printed, due to the increase of the friction between the cleaning blade 465 and the transfer belt 461.

Next, the operation when the toner accumulation member 470 is provided in the transfer portion 460 (FIG. 1) according to the embodiment will be described.

As shown in FIG. 2, a part of the waste toner 472 scraped off from the surface of the transfer belt 461 by the cleaning blade 465 is accumulated on the toner accumulation member 470. The waste toner 472 is accumulated until the waste toner 472 reaches the surface of the transfer belt 461 and the tip of the cleaning blade 465. The waste toner 472 accumulated on the toner accumulation member 470 exceeding a predetermined amount falls from the toner accumulation member 470 through the space S (FIG. 6), and is stored in the toner box 466.

The waste toner 472 accumulated on the toner accumulation member 470 contacts and adheres to the transfer belt 461 and the cleaning blade 465. The waste toner 472 adhering to the transfer belt 461 and the cleaning blade 465 is supplied to a contact portion between the transfer belt 461 and the cleaning blade 465 as lubricant.

The space S between the toner accumulation member 470 and the cleaning blade 465 is adjusted so that the waste toner 472 (accumulated on the toner accumulation member 470) contacts and adheres to the transfer belt 461 and the cleaning blade 465 so that the waste toner 472 (as lubricant) is supplied to the contact portion between the transfer belt 461 and the cleaning blade 465 before the preliminarily coated toner (i.e., lubricant toner) on the cleaning blade 465 runs out, detailed description being given later.

As described above, the cleaning apparatus 480 according to Embodiment 1 is configured to supply the waste toner 472 accumulated on the toner accumulation member 470 to the contact portion between the transfer belt 461 and the cleaning blade 465. With such an arrangement, the increase of the friction between the transfer belt 461 and the cleaning blade 465 can be restricted, and therefore the bending of the tip of the cleaning blade 465 can be prevented.

The space S between the tip of the cleaning blade 465 and the toner accumulation member 470 will be described with reference to FIG. 6.

As the space S becomes narrower, the ratio of the amount of the waste toner 472 accumulated on the toner accumulation member 470 to the amount of the waste toner 472 scraped off from the surface of the transfer belt 461 increases. As the space S becomes wider, the ratio of the amount of the waste toner 472 accumulated on the toner accumulation member 470 to the amount of the waste toner 472 scraped off from the surface of the transfer belt 461 decreases. Therefore, as the space S becomes narrower, the contact pressure of the waste toner 472 (accumulated on the toner accumulation member 470) urged against the transfer belt 461 and the cleaning blade 465 may increase, with the result that the cleaning blade 465 can not sufficiently scrape off the toner 471 (FIG. 2) from the surface of the transfer belt 461, i.e., a passing-through of the toner 471 occurs. In contrast, as the space S becomes wider, the waste toner 472 is not sufficiently supplied to the contact portion between the cleaning blade 465 and the transfer belt 461, and therefore the bending of the tip of the cleaning blade 465 may occur.

Further, the time after the accumulation of the waste toner 472 on the toner accumulation member 470 is started until the accumulated waste toner 472 reaches the contact portion between the cleaning blade 465 and the transfer belt 461 is determined based on the space S.

The space S is determined by distances A and B that represent positional relationship between the toner accumulation member 470 and the cleaning blade 465. The distance A is a distance from the toner accumulation member 470 to the surface of the transfer belt 461, and the distance B is a distance in the moving direction (indicated by the arrow M) of the transfer belt 461 from the tip of the toner accumulation member 470 to the contact portion between the cleaning blade 465 and the transfer belt 461.

Further, the toner preliminarily coated as lubricant on the cleaning blade 465 during the manufacturing runs out when approximately 2000 recording sheets are printed in the case where the recording sheet of A4 size is fed in the long edge direction. Therefore, it is necessary to set the distances A and B so that the waste toner 472 accumulated on the toner accumulation member 270 reaches the contact portion between the cleaning blade 465 and the transfer belt 461 before the preliminarily coated toner runs out.

Next, a description will be made to an experiment on the relationship between the distances A and B and toner supply performance (i.e., performance for supplying the toner to the cleaning blade 465), as well as a cleaning performance (i.e., performance with which the cleaning blade 465 cleans the transfer belt 461).

The printing test is performed while setting the distances A and B in various ways using the image forming apparatus having the cleaning blade 465 formed of urethane rubber whose thickness is 2 mm and the toner accumulation member 470 formed of a rigid body. The experimental conditions are as follows:

Length of toner accumulation member 470 in moving direction of transfer belt: 6 mm (fixed)

Size of recording (printing) sheet: A4 size

Feeding direction: Long edge direction

Number of recording sheets: 2000 sheets

Printing pattern: Ruling pattern (at a low duty)

Environmental temperature: 28° C.

Environment humidity: 80%

Regarding the above described printing pattern, "low duty" means that printing density of predetermined area is less than or equal to 5%.

TABLE 1 shows evaluation results of the toner supply performance to the cleaning blade 465 and the cleaning performance of the cleaning blade 465 for cleaning the transfer belt 461 according to the experimental. In TABLE 1, evaluation criteria of determining whether the result is excellent (O) or not (X) are as follows:

The toner supply performance is evaluated to be excellent (O) in the case where the waste toner 472 on the toner accumulation member 470 reaches the tip of the cleaning blade 465 as shown in FIG. 2 after the printing of 2000 recording sheets. The toner supply performance is evaluated to be not-excellent (X) in the case where the waste toner 472 on the toner accumulation member 470 does not reach the tip of the cleaning blade 465 after the printing of 2000 recording sheets.

Further, the cleaning performance is evaluated to be excellent (O) in the case where no contamination is present on the back surface of the recording sheet after the printing of 2000 recording sheets. The cleaning performance is evaluated to be not-excellent (X) in the case where contamination is present on the back surface of the recording sheet after the printing of 2000 recording sheets. In this regard, when the cleaning failure occurs, the toner adhering to the surface of the transfer belt 461 is not scraped off by the cleaning blade 465, so that the contamination (toner) is present on the back side of the recording sheet.

TABLE 1

| | | DISTANCE B (mm) | | | | | | EVALUATION |
|---|---|---|---|---|---|---|---|---|
| | | 4 | 3 | 2 | 1 | 0 | −1 | ITEM |
| DISTANCE A (mm) | 2 | X | ○ | ○ | ○ | ○ | ○ | TONER SUPPLY |
| | | X | X | X | X | X | X | CLEANING |
| | 3 | X | ○ | ○ | ○ | ○ | ○ | TONER SUPPLY |
| | | ○ | ○ | ○ | X | X | X | CLEANING |
| | 4 | X | ○ | ○ | ○ | ○ | ○ | TONER SUPPLY |
| | | ○ | ○ | ○ | X | X | X | CLEANING |
| | 5 | X | ○ | ○ | ○ | ○ | ○ | TONER SUPPLY |
| | | ○ | ○ | ○ | ○ | ○ | X | CLEANING |
| | 6 | X | ○ | ○ | ○ | ○ | ○ | TONER SUPPLY |
| | | ○ | ○ | ○ | ○ | ○ | X | CLEANING |
| | 7 | X | ○ | ○ | ○ | ○ | ○ | TONER SUPPLY |
| | | ○ | ○ | ○ | ○ | ○ | X | CLEANING |

TABLE 1-continued

| | DISTANCE B (mm) | | | | | | EVALUATION |
|---|---|---|---|---|---|---|---|
| | 4 | 3 | 2 | 1 | 0 | −1 | ITEM |
| 8 | X | ○ | ○ | ○ | ○ | ○ | TONER SUPPLY |
| | ○ | ○ | ○ | ○ | ○ | X | CLEANING |
| 9 | X | X | X | ○ | ○ | ○ | TONER SUPPLY |
| | ○ | ○ | ○ | ○ | ○ | X | CLEANING |
| 10 | X | X | X | X | ○ | ○ | TONER SUPPLY |
| | ○ | ○ | ○ | ○ | ○ | X | CLEANING |
| 11 | X | X | X | X | X | X | TONER SUPPLY |
| | ○ | ○ | ○ | ○ | ○ | X | CLEANING |

(○: excellent, X: not-excellent)

According to the experimental result shown in TABLE 1, it is possible to determine that the waste toner can effectively be supplied to the contact portion between the cleaning blade 465 and the transfer belt 461 in the case where the distances A and B (representing the positional relationship between the toner accumulation member 470 and the cleaning blade 465) satisfy the following condition (1), (2) or (3):

$$2.0\ \text{mm} \leqq B \leqq 3.0\ \text{mm and } 3.0\ \text{mm} \leqq A \leqq 8.0\ \text{mm}, \quad (1)$$

$$0.0\ \text{mm} \leqq B \leqq 1.0\ \text{mm and } 5.0\ \text{mm} \leqq A \leqq 9.0\ \text{mm, and} \quad (2)$$

$$B = 0.0\ \text{mm and } A = 10.0\ \text{mm}. \quad (3)$$

As described above, according to the image forming apparatus of Embodiment 1, the toner accumulation member 470 is provided at a predetermined distance from the cleaning blade 465 so that the waste toner 472 is accumulated on the toner accumulation member 470 and is supplied (as lubricant) to the contact portion between the transfer belt 461 and the cleaning blade 465. Therefore, the increase of the friction between the cleaning blade 465 and the transfer belt 461 can be restricted. Accordingly, it becomes possible to prevent the bending of the tip of the cleaning blade 465, and to prevent the failure in removing the toner 471 (FIG. 2) from the surface of the transfer belt 461.

Figure 7:
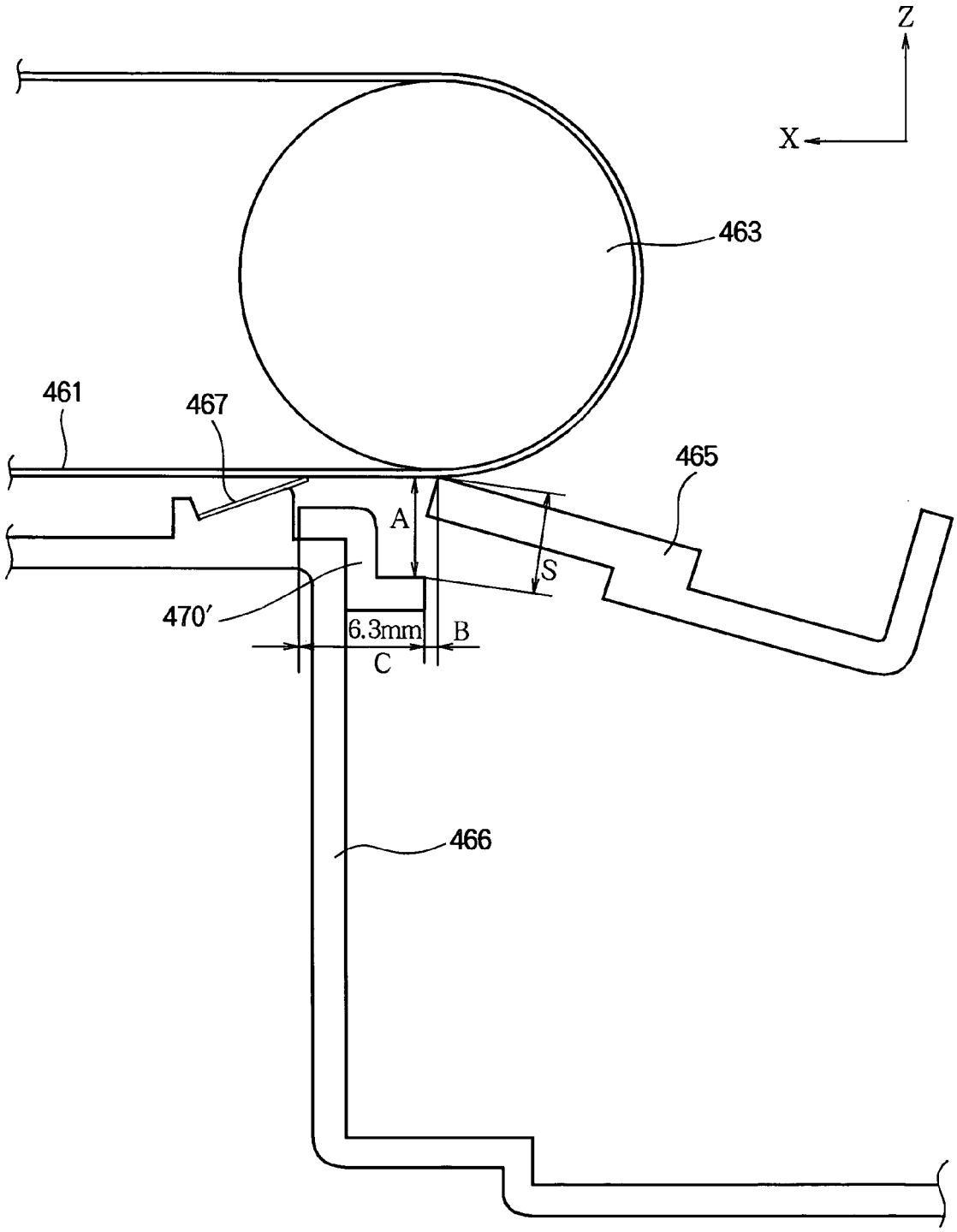
FIG. 7 shows a specific example of Embodiment 1 designed in consideration of productivity.

FIG. 7 shows a specific example of Embodiment 1 designed in consideration of productivity. In this specific example, a toner accumulation member 470' has a substantially Z-shaped cross section (cut along a plane perpendicular to the longitudinal direction of the toner accumulation member 470'). The space S between the toner accumulation member 470' and the cleaning blade 465 is wider than that of the toner accumulation member 470 shown in FIG. 6, and the length C of the toner accumulation member 470' (specifically, set to 6.3 mm) in the moving direction of the transfer belt 461 is longer than that of the toner accumulation portion 470 shown in FIG. 6. With such dimensions, the same advantages as the above described Embodiment 1 are obtained, although the sectional shape of the toner accumulation member 470' is different from the sectional shape of the toner accumulation member 470.

Embodiment 2

Figure 8:
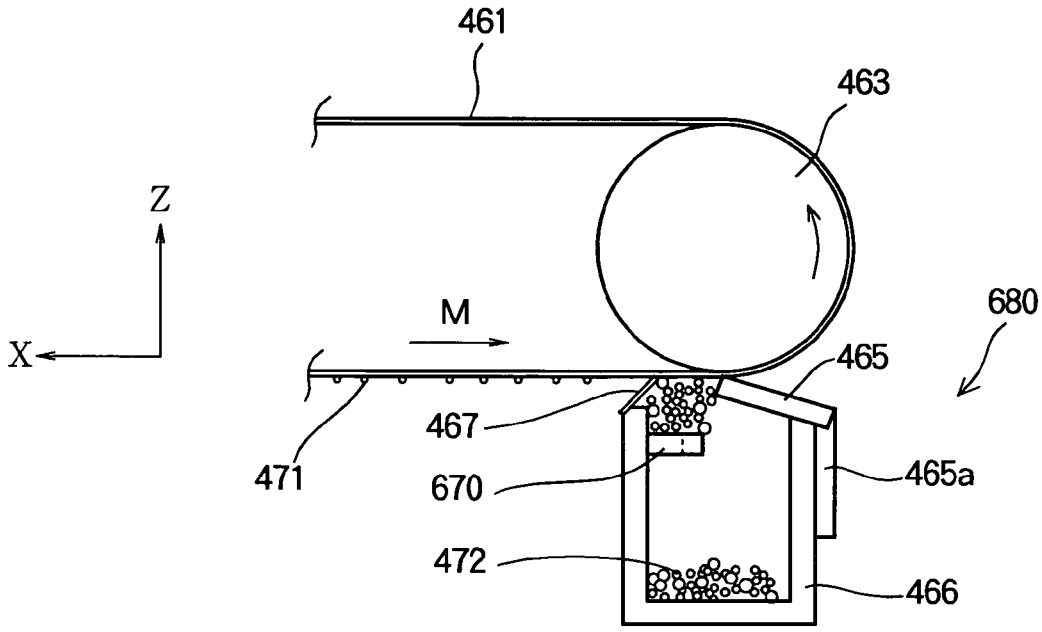
FIG. 8 is an enlarged view showing a cleaning apparatus including a cleaning blade and a toner box according to Embodiment 2 and surroundings thereof.
Figure 9:
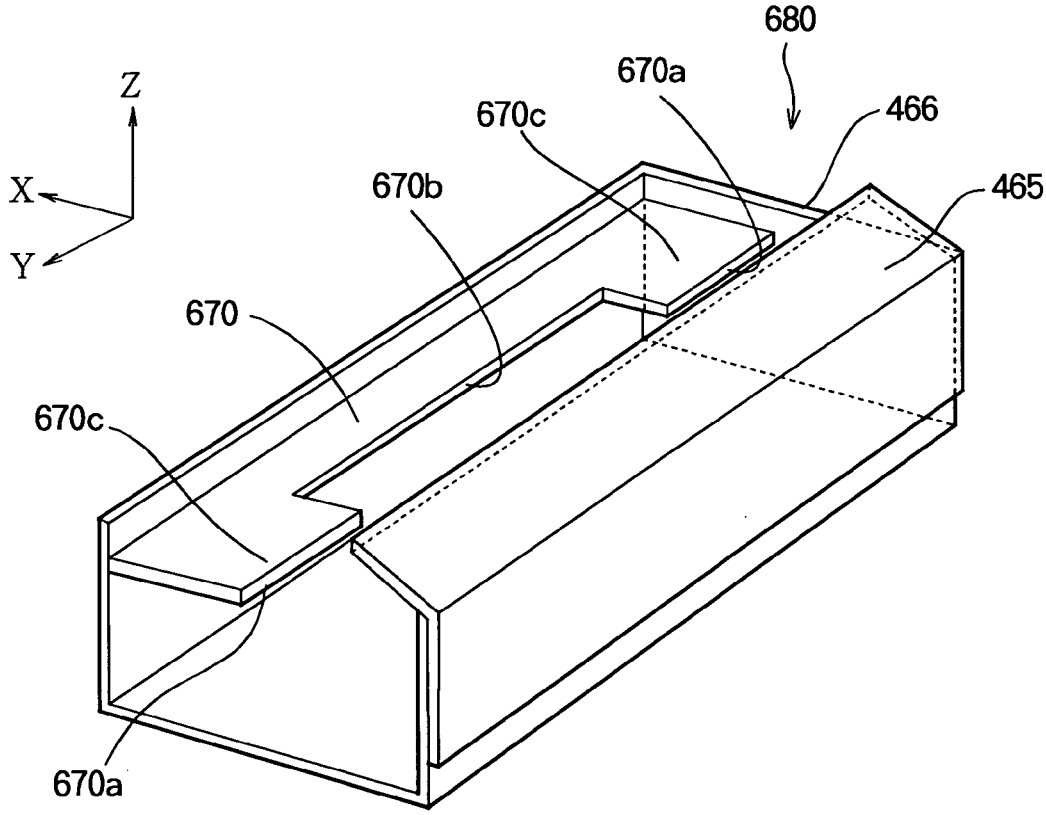
FIG. 9 is a perspective view showing an external configuration of the cleaning apparatus according to Embodiment 2 as obliquely seen from above.
Figure 10:
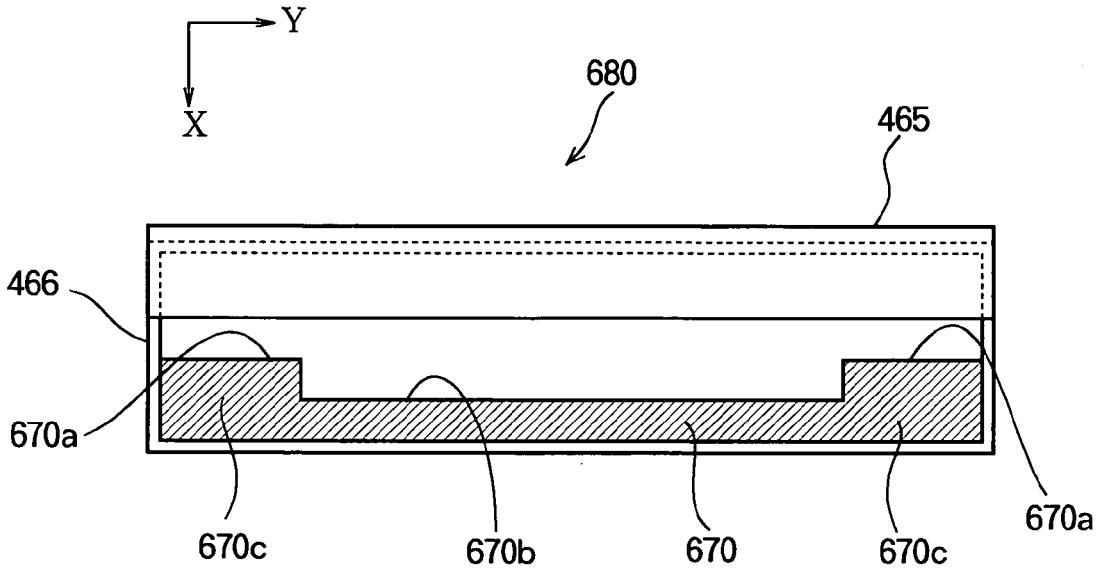
FIG. 10 is a plan view showing the cleaning apparatus according to Embodiment 2.
Figure 11:
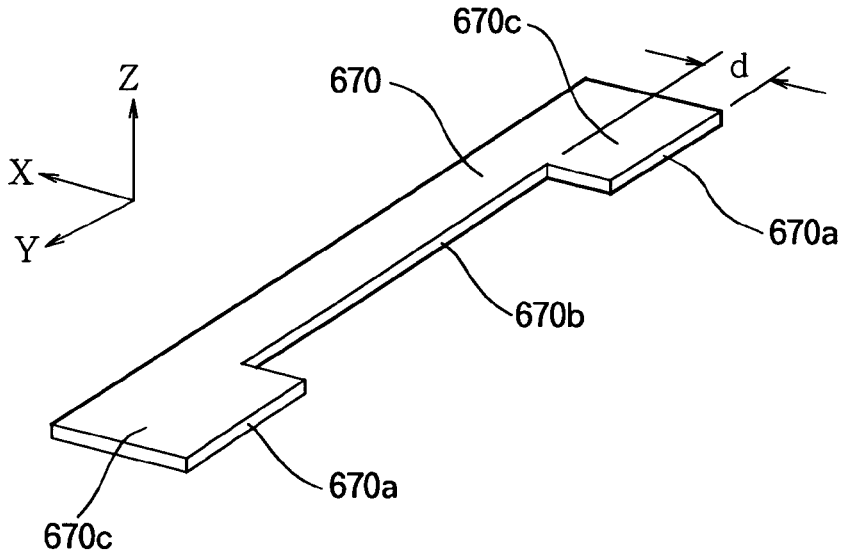
FIG. 11 is a perspective view showing an external form of a toner accumulation member of the cleaning apparatus according to Embodiment 2.

FIG. 8 is an enlarged view showing a cleaning apparatus 680 having a cleaning blade 465 and a toner box 466 of an image forming apparatus according to Embodiment 2 of the present invention and surroundings thereof. FIG. 9 is a perspective view showing an external configuration of the cleaning apparatus 680 as obliquely seen from above. FIG. 10 is a plan view showing the cleaning apparatus 680. FIG. 11 is a perspective view showing an external form of a toner accumulation member 670 of the cleaning apparatus 680. In FIG. 9, near side wall of the toner box 466 is omitted so that the positional relationship between the toner box 466 and the toner accumulation member 670 can be easily seen.

The difference between the image forming apparatus having the cleaning apparatus 680 of Embodiment 2 and the image forming apparatus 1000 having the cleaning apparatus 480 (FIG. 2) of Embodiment 1 is in the shape of the toner accumulation member 670 (470). Therefore, components of the image forming apparatus (having the cleaning apparatus 680) of Embodiment 2 which are the same as those of the image forming apparatus 1000 of Embodiment 1 are assigned the same reference numerals or omitted in drawings, and duplicate descriptions thereof are omitted. The description is emphasized on the difference between the image forming apparatus of Embodiment 2 and the image forming apparatus of Embodiment 1. The components of the image forming apparatus of Embodiment 2 except the toner accumulation member 670 are the same as those of the image forming apparatus 1000 of Embodiment 1, and therefore FIG. 1 is referred as necessary.

As shown in FIGS. 8 through 11, the toner accumulation member 670 of Embodiment 2 has a plate-like shape as the toner accumulation member 470 (FIG. 5) of Embodiment 1. However, the toner accumulation member 670 has a cutaway concave portion 670*b* formed on the side of the toner accumulation member 670 facing the cleaning blade 465. The cutaway concave portion 670*b* is formed at the center of the toner accumulation member 670. The cutaway concave portion 670*b* is. Convex portions 670*c* are formed at both sides of the cutaway concave portion 670*b*, and protrude toward the cleaning blade 465. Each convex portion 670*c* has a tip portion 670*a*.

Figure 12:
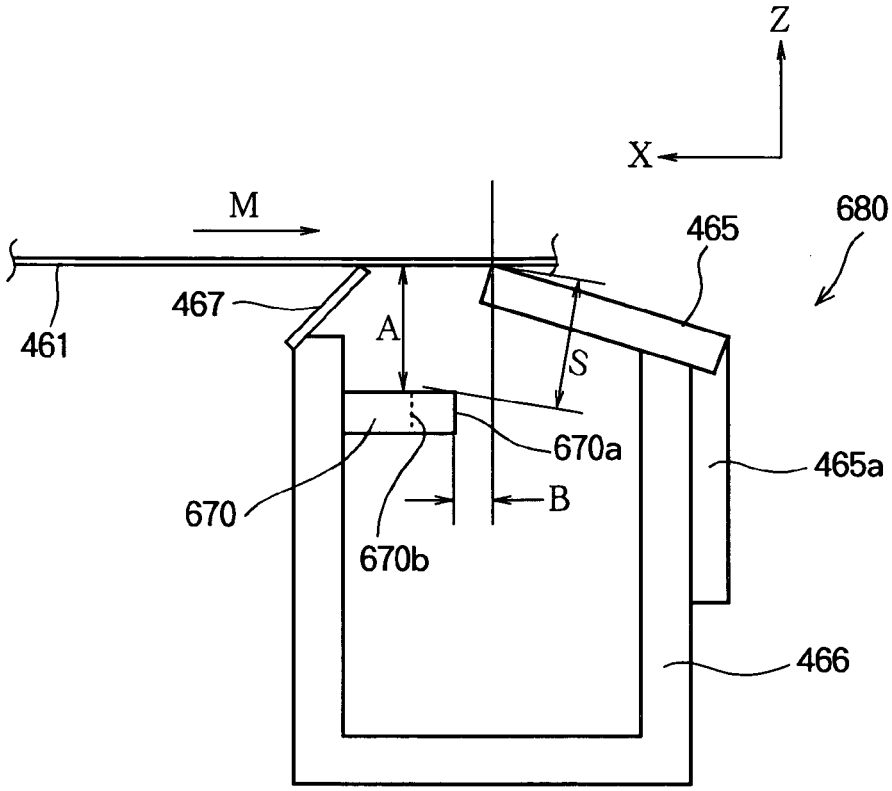
FIG. 12 is a sectional view showing an internal configuration of the cleaning apparatus according to Embodiment 2.

FIG. 12 is a sectional view showing an internal configuration of the cleaning apparatus 680 according to Embodiment 2. As shown in FIG. 12, a space S is formed between the cleaning blade 465 and the tip portions 670*a* of the convex portions 670*c* of the toner accumulation member 670. The space S is determined by the dimensions A and B representing the positional relationship between the cleaning blade 465 and the toner accumulation member 670. The toner accumulation member 670 is disposed so that the tip portions 670*a* of the convex portions 670*c* are parallel to the cleaning blade 465 in the longitudinal direction. In other words, the toner accumulation member 670 extends in the width direction of the transfer belt 461, and is disposed parallel to the surface of the transfer belt 461.

In this regard, the distance A is a distance from the toner accumulation member 670 to the surface of the transfer belt 461, and the distance B is a distance in the moving direction of the transfer belt 461 from the tip portions 670*a* of the convex portions 670*c* of the toner accumulation member 670 to the contact portion between the cleaning blade 465 and the transfer belt 461. The details of the distances A and B are the same as those described in Embodiment 1, and therefore duplicate descriptions thereof are omitted.

Here, the reason for providing the cutaway concave portion 670*b* on the toner accumulation member 670 in Embodiment 2 will be described.

For example, if the cleaning apparatus 680 shown in FIG. 8 has no toner accumulation member 670, a bending of the cleaning blade 465 easily occurs at a contact portion between the cleaning blade 465 and the transfer belt 461 as described above. Particularly, it is known that both ends of the cleaning blade 465 in the longitudinal direction are easily bent.

This is because, when the printing is performed on the recording sheet 101, both ends of the cleaning blade 465 in the longitudinal direction are positioned outside a printable area, and therefore are not supplied with sufficient amount of the toner 471 (as lubricant) from the photosensitive drum 431 (FIG. 1) via the transfer belt 461. Further, since both end surfaces of the cleaning blade 465 in the longitudinal direction are not supported, the end portions of the cleaning blade 465 have lower strength than the center portion (which continues to both end portions), with the result that the end portions of the cleaning blade 465 tend to be easily bent. In the portion of the cleaning blade 465 corresponding to the printable area, sufficient amount of toner 471 (adhering to the surface of the transfer belt 461) is supplied to the contact portion between the cleaning blade 465 and the transfer belt 461, and therefore it is not likely that the toner runs out.

For these reasons, the cleaning blade 465 of the cleaning apparatus 680 of Embodiment 2 has the cutaway concave portion 670*b* formed at the center portion to have a depth d so as to supply the sufficient amount of waste toner 472 (accumulated on the toner accumulation member 670) to both end portions of the cleaning blade 465, while limiting the amount of waste toner 472 supplied to the contact portion of the cleaning blade 465 corresponding to the printable area.

Next, the operation of the above configured cleaning apparatus 680 will be described.

The driving roller 462 is rotated counterclockwise as shown by an arrow in FIG. 1, and the transfer belt 462 moves in a direction shown by an arrow M in FIG. 8. The toner 471 remaining on the photosensitive drum 431 without being transferred to the recording sheet 101 adheres to the surface of the transfer belt 461 moving in the direction indicated by the arrow M. As shown in FIG. 8, when the transfer belt 461 moves, the toner 471 adhering to the surface of the transfer belt 461 is scraped off at a contact portion between the transfer belt 461 and the cleaning blade 465, and the scraped-off toner 471 (i.e., waste toner 472) is stored in the toner box 466.

A part of the waste toner 472 scraped off from the surface of the transfer belt 461 by the cleaning blade 465 is accumulated on the toner accumulation member 670. The waste toner 472 is accumulated until the waste toner 472 reaches the surface of the transfer belt 461 and the tip of the cleaning blade 465. The waste toner 472 accumulated on the toner accumulation member 670 exceeding a predetermined amount falls through a space including the cutaway concave portion 670*b* to be stored in the toner box 466, and a part of the waste toner 472 on the toner accumulation member 670 moves in the longitudinal direction, for example, from the center portion to both end portions (i.e., the convex portions 670*c*) of the toner accumulation member 670.

Since the toner accumulation member 670 has the cutaway concave portion 670*b* on the side facing the cleaning blade 465, the waste toner 472 accumulated on the convex portions 670*c* (on both sides of the cutaway concave portion 670*b*) adheres to the transfer belt 461 and the cleaning blade 465, and is supplied to the contact portion between the cleaning blade 465 and the transfer belt 461 as lubricant. At the center portion where the cutaway concave portion 670*b* is formed, the accumulating amount of the waste toner 472 is relatively small, and the distance from the cleaning blade 465 is relatively long, with the result that the amount of waste toner 472 supplied to the corresponding portion of the cleaning blade 465 is limited.

Since the toner 471 tends to less adhere to the end portions of the transfer belt 461 as described above, the waste toner 472 tends to be less accumulated on the end portions of the convex portions 670*c* in the longitudinal direction of the toner accumulation member 670. However, the accumulation of the waste toner 472 on the end portions of the toner accumulation member 670 is supplemented by the waste toner 472 moving from the inner side (i.e., center side) of the toner accumulation member 670 toward the outer side (i.e., the end side) of the toner accumulation member 670.

If the amount of the waste toner 472 (as lubricant) supplied to the contact portion between the cleaning blade 465 and the transfer belt 461 is too large, a large load is applied to the cleaning blade 465, so that the passing-through of the waste toner 472 occurs. Therefore, the cutaway concave portion 670*b* is formed at the center portion of the toner accumulation member 670 corresponding to the center portion of the cleaning blade 465 where a relatively large amount of the toner 471 is supplied (i.e., where the bending of the cleaning blade 465 is less likely to occur). The distance from the cutaway portion 670*b* to the cleaning blade 465 is relatively large, and the amount of the waste toner 472 supplied to the cleaning blade 465 is reduced.

Figure 13:
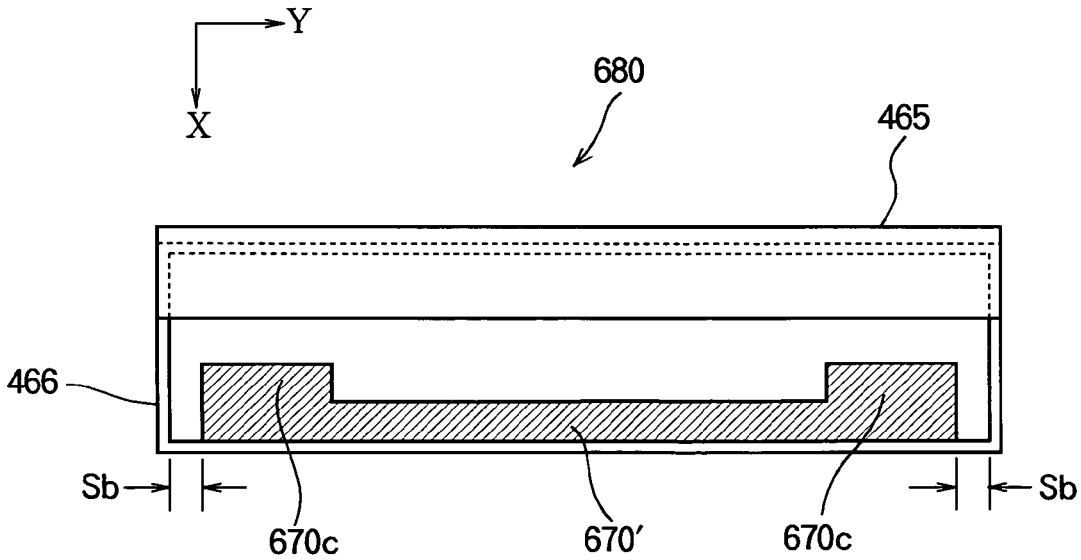
FIG. 13 is a plan view showing a modification of a toner accumulation member according to Embodiment 2.

FIG. 13 is a plan view showing a modification of the toner accumulation member according to Embodiment 2 of the present invention.

Both end portions of the cleaning blade 465 have relatively low strength as described above, and therefore, if the waste toner 472 is excessively accumulated on the convex portions 670*c*, the passing-through of the waste toner 472 may occur. Further, the waste toner 472 accumulated on the convex portions 670*c* is prevented from moving further outward in the longitudinal direction of the toner accumulation member 670 by the toner box 466, although the waste toner 472 is able to move inward (i.e., toward the space S including the concave portion 670*b*). Therefore, the waste toner 472 tends to be continuously accumulated on the end portions of the toner accumulation member 670, and may cause the passing-through of the waste toner 472.

For solving this problem, the dimensions of the toner accumulation member 670' of the modification shown in FIG. 13 are determined so that spaces Sb are formed between the toner box 466 and both ends (in the longitudinal direction) of the toner accumulation member 670'. With such a configuration, the waste toner 472 on the convex portion 670*c* can move further outward and fall through the spaces Sb. Therefore, the excessive accumulation of the waste toner 472 on the convex portion 670*c* can be prevented.

As described above, according to the image forming apparatus of Embodiment 2, it becomes possible to supply suitable amount of waste toner (as lubricant) to both end portions of the cleaning blade 465 corresponding to the outside of the printable area where an insufficient amount of toner adhering to the transfer belt is supplied. Further, it becomes possible to prevent the supply of excessive amount of waste toner to the center portion of the cleaning blade where sufficient amount of toner is supplied (i.e., where the bending is less likely to occur). In this way, the waste toner is supplied in a balanced manner, and therefore it becomes possible to prevent the deterioration in cleaning performance at the center portion of the cleaning blade due to the passing-through of the waste toner, and to prevent the bending of the cleaning blade at both ends of the cleaning blade.

Embodiment 3

Figure 14:
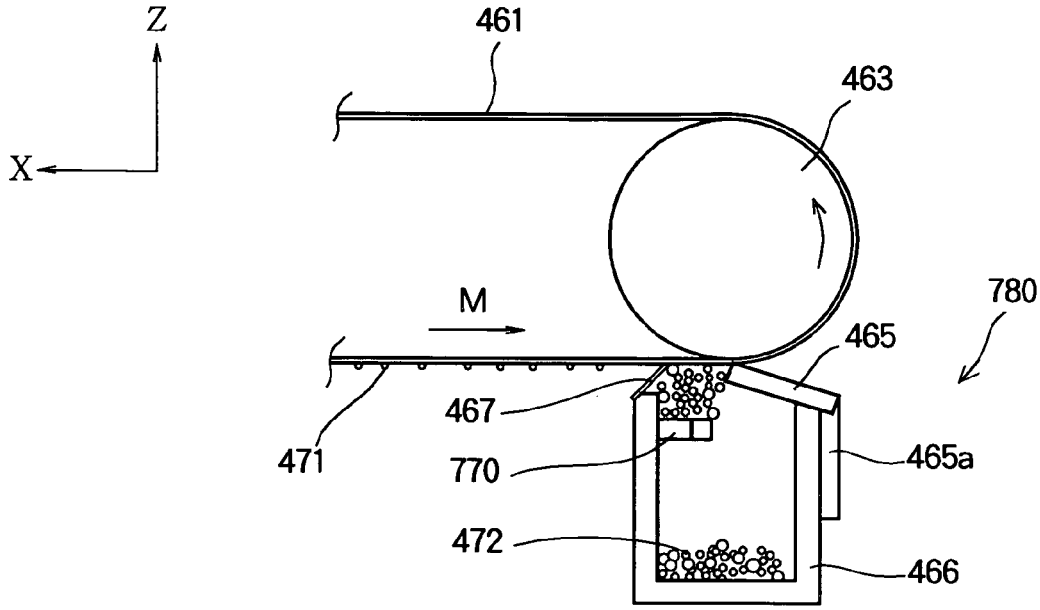
FIG. 14 is an enlarged view showing a cleaning apparatus including a cleaning blade and a toner box according to Embodiment 3 and surroundings thereof.
Figure 15:
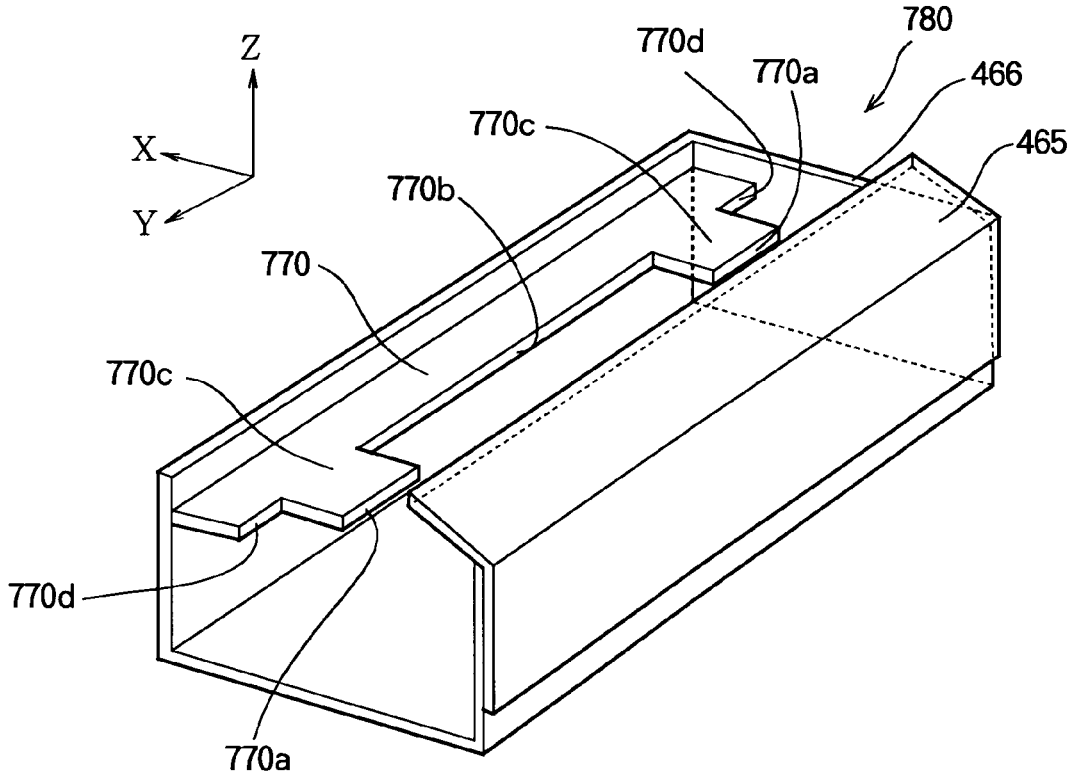
FIG. 15 is a perspective view showing an external configuration of the cleaning apparatus according to Embodiment 3 as obliquely seen from above.
Figure 16:
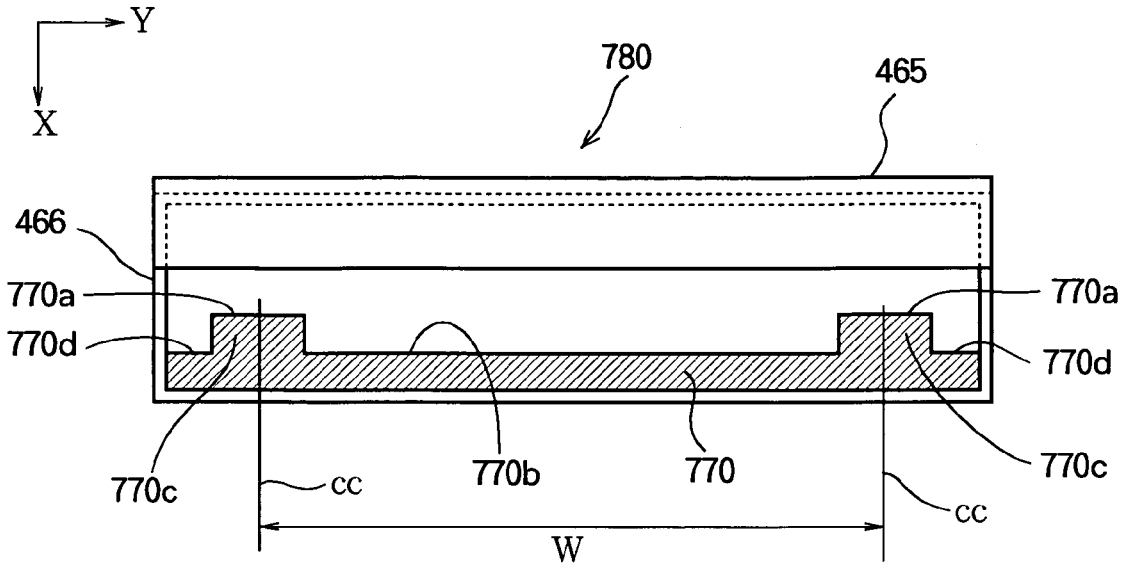
FIG. 16 is a plan view showing the cleaning apparatus according to Embodiment 3.
Figure 17:
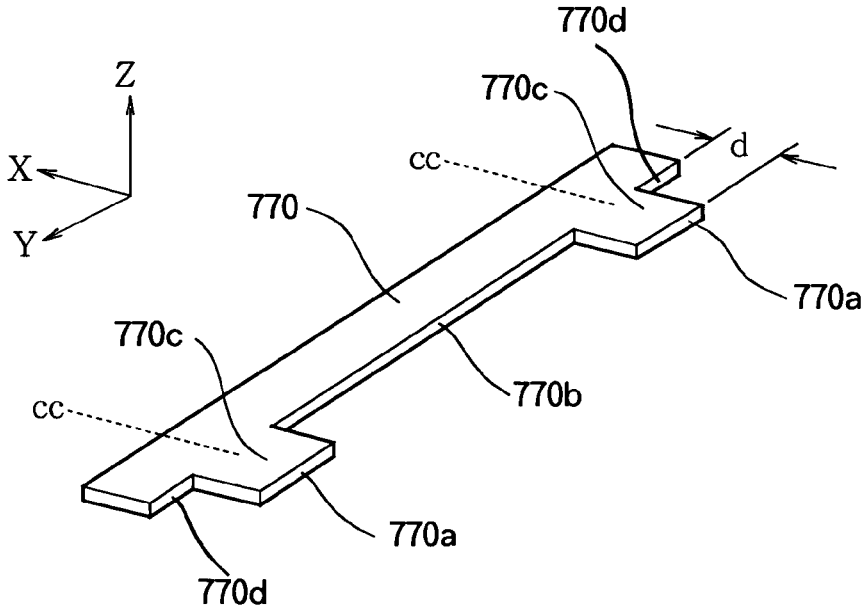
FIG. 17 is a perspective view showing an external form of a toner accumulation member of the cleaning apparatus according to Embodiment 3.

FIG. 14 is an enlarged view showing a cleaning apparatus 780 having a cleaning blade 465 and a toner box 466 of an image forming apparatus of Embodiment 3 of the present invention and surroundings thereof. FIG. 15 is a perspective view showing an external configuration of the cleaning apparatus 780 as obliquely seen from above. FIG. 16 is a plan view showing the cleaning apparatus 780. FIG. 17 is a perspective view showing an external form of a toner accumulation member 770 of the cleaning apparatus 780. In FIG. 15, near side wall of the toner box 466 is omitted so that the positional relationship between the toner box 466 and the toner accumulation member 770 can be easily seen.

The difference between the image forming apparatus having the cleaning apparatus 780 of Embodiment 2 and the image forming apparatus having the cleaning apparatus 480 (FIG. 2) of Embodiment 1 is in the shape of the toner accumulation member 770. Therefore, components of the image forming apparatus (having the cleaning apparatus 780) of Embodiment 3 which are the same as those of the image forming apparatus 1000 of Embodiment 1 are assigned the same reference numerals or omitted in drawings, and duplicate descriptions thereof are omitted. The description is emphasized on the difference between the image forming apparatus of Embodiment 3 and the image forming apparatus of Embodiment 1. The components of the image forming apparatus of Embodiment 3 except the toner accumulation member 770 are the same as those of the image forming apparatus 1000 of Embodiment 1, and therefore FIG. 1 is referred as necessary.

As shown in FIGS. 14 through 17, the toner accumulation member 770 of Embodiment 3 has a plate-like shape as the toner accumulation member 470 (FIG. 5) of Embodiment 1. However, the toner accumulation member 770 has a cutaway concave portion 770*b* formed at a center of a side facing the cleaning blade 465, and cutaway end portions 770*d* formed at both ends of the side facing the cleaning blade 465. Convex portions 770*c* are formed on the side of the toner accumulation member 470 facing the cleaning blade 465 except where the cutaway concave portion 770*b* and the cutaway end portions 770*d* are formed. The convex portions 770*c* have tip portions 770*a* facing the cleaning blade 465.

Figure 18:
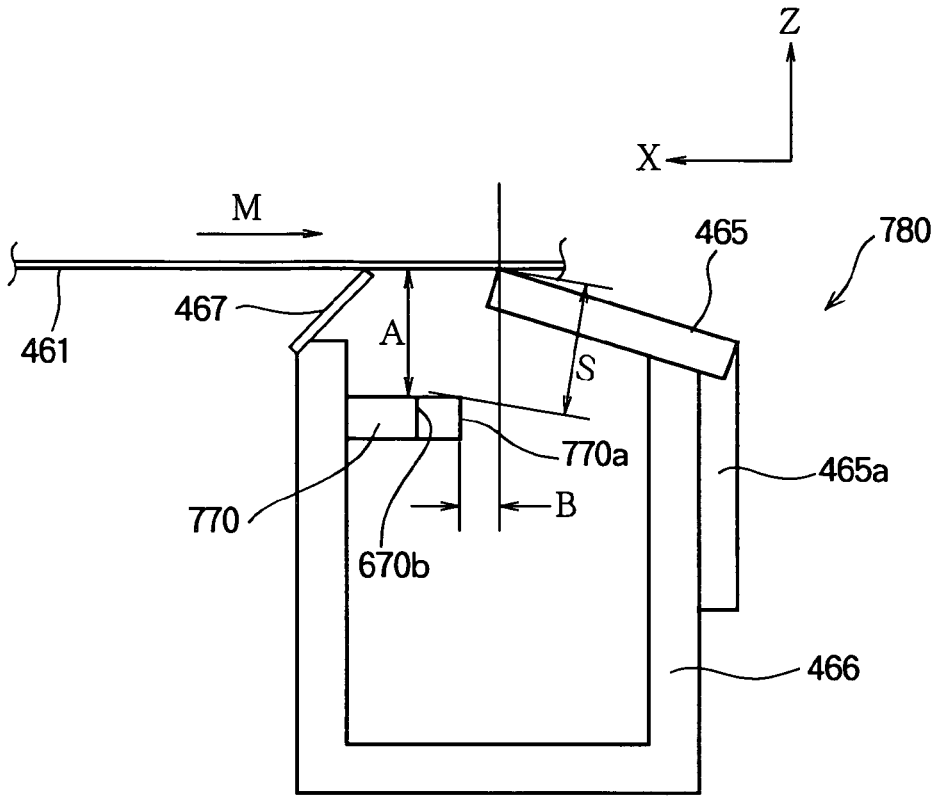
FIG. 18 is a sectional view showing an internal configuration of the cleaning apparatus according Embodiment 3.

FIG. 18 is a sectional view showing an internal configuration of the cleaning apparatus 780 according to Embodiment 3. As shown in FIG. 18, a space S is formed between the cleaning blade 465 and the tip portions 770*a* of the convex portion 770*c* of the toner accumulation member 770. The space S is determined by dimensions A and B representing the positional relationship between the cleaning blade 465 and the toner accumulation member 770. The toner accumulation member 770 is disposed so that the tip portions 770*a* of the convex portions 770*c* are parallel to the cleaning blade 465 in the longitudinal direction. In other words, the toner accumulation member 770 extends in the width direction of the transfer belt 461, and is disposed parallel to the surface of the transfer belt 461.

In this regard, the distance A is a distance from the toner accumulation member 770 to the surface of the transfer belt 461, and the distance B is a distance in the moving direction of the transfer belt 461 from the tip portion 770*a* of the convex portion 770*c* of the toner accumulation member 770 to the contact portion between the cleaning blade 465 and the transfer belt 461. The details of the distances A and B are the same as those described in Embodiment 1, and therefore duplicate descriptions thereof are omitted.

Here, the reason for providing the cutaway concave portion 770*b* and cutaway end portions 770*d* on the toner accumulation member 770 in Embodiment 3 will be described.

For example, if the cleaning apparatus 780 shown in FIG. 14 has no toner accumulation member 770, a bending of the cleaning blade 465 easily occurs at a contact portion between the cleaning blade 465 and the transfer belt 46.1 as described above. Particularly, if continuous printing is performed on the recording sheets 101 of a particular size, it is known that bending tends to occur at portions of the cleaning blade 465 corresponding to the ends portions of the recording sheet 101 in the width direction.

The reason of the occurrence of bending is as follows: In the case where printing is performed on large number of recording sheets 101 having the same size, the toner 471 or paper particle is not likely to adhere to portions on the transfer belt 461 corresponding to end portions of the recording sheet 101 in the width direction. This is considered to be because the end portions of the recording sheet 101 in the width direction are outside a printable area, and because there are noncontact portion (where the photosensitive drum 431 does not contact the transfer belt 461) in the vicinity of the end portions of the recording sheet 101 according to the thickness of the recording sheet 101. Therefore, when the transfer belt 461 moves to the contact portion, the toner 471 is not sufficiently supplied to portions of the cleaning blade 465 corresponding to the end portions of the recording sheet 101 in the width direction. As a result, at the portions of the cleaning blade 465 corresponding to the end portions of the recording sheet 101, the preliminarily coated toner on the surface of the cleaning blade 465 decreases, and the friction between the transfer belt 461 and the cleaning blade 465 increases, with the result that a bending of the cleaning blade 465 tends to occur at the portions corresponding to the end portions of the recording sheet 101.

In this regard, at other portions of the cleaning blade 465 than those corresponding to the end portions of the recording sheet 101, the toner 471 adhering to the surface of the transfer belt 461 is supplied to the contact portion between the cleaning blade 465 and the transfer belt 461 as lubricant, and therefore the toner is not likely to run out.

For these reasons, the cleaning apparatus 780 according to Embodiment 3 is configured to supply sufficient amount of waste toner 472 (accumulated on the toner accumulation member 770) to the portions of the cleaning blade 465 corresponding to the end portions of the recording sheet 101 as lubricant, and to limit the amount of the waste toner 472 supplied to other portions of the cleaning blade 465. Therefore, the cutaway convex portion 770*b* and the cutaway end portions 770*d* are formed on the toner accumulation member 770 to have the depth d so that the center lines cc (FIGS. 17 and 18) of the convex portions 770*c* are substantially aligned with ends of the recording sheet 101 in the width (W) direction of the recording sheet 101.

Next, the operation of the above configured cleaning apparatus 780 will be described.

The driving roller 462 is rotated counterclockwise as shown by an arrow in FIG. 1, and the transfer belt 462 moves in a direction shown by an arrow M in FIG. 14. The toner 471 remaining on the photosensitive drum 431 without being transferred to the recording sheet 101 adheres to the surface of the transfer belt 461 moving in the direction indicated by the arrow M. As shown in FIG. 14, when the transfer belt 461 moves, the toner 471 adhering to the surface of the transfer belt 461 is scraped off at the contact portion between the transfer belt 461 and the cleaning blade 465, and the scraped-off toner 471 (i.e., waste toner 472) is stored in the toner box 466.

A part of the waste toner 472 scraped off from the surface of the transfer belt 461 by the cleaning blade 465 is accumulated on the toner accumulation member 770. The waste toner 472 is accumulated until the toner waste 472 reaches the surface of the transfer belt 461 and the tip of the cleaning blade 465. The waste toner 472 accumulated on the toner accumulation member 770 exceeding a predetermined amount falls through a space including the cutaway concave portion 770*b* and the cutaway end portions 770*d* to be stored in the toner box 466, and a part of the waste toner 472 on the toner accumulation member 770 moves in the longitudinal direction, for example, from the center portion to both end portions of the toner accumulation member 770.

The toner accumulation member 770 has the cutaway concave portion 770*b* and the cutaway end portions 770*d* at the side facing the cleaning blade 465, and the waste toner 472 accumulated on the convex portions 770*c* on both sides of the cutaway concave portion 770*b* adheres to the transfer belt 461 and the cleaning blade 465, and is supplied to the contact portion between the cleaning blade 465 and the transfer belt 461 as lubricant. At the portions where the cutaway concave portion 770*b* and the cutaway end portions 70*c* are formed, the amount of the accumulated waste toner 472 is relatively small, and the distance from the cleaning blade 465 is relatively long, with the result that the amount of waste toner supplied to the corresponding portions of the cleaning blade 465 is limited.

Since the toner 471 tends to less adhere to the portions of the transfer belt 461 corresponding to the end portions of the recording sheet 101 as described above, the waste toner 472 tends to be less accumulated on the end portions of the convex portions 770*c* in the longitudinal direction. However, the accumulation of the waste toner 472 on the end portions of the toner accumulation member 770 is supplemented by the waste toner 472 moving from the inner side (i.e., the center side) of the toner accumulation member 770 to the outer side (i.e., the end side) of the toner accumulation member 770.

If the amount of the waste toner 472 (as lubricant) supplied to the contact portion between the cleaning blade 465 and the transfer belt 461 is too large, a large load is applied to the cleaning blade 465, so that the passing-through of the waste toner 472 may occur. Therefore, the cutaway concave portion 770*b* and the cutaway end portions 770*d* are formed at the portions of the toner accumulation member 770 corresponding to portions of the cleaning blade 465 where a relatively large amount of the waste toner 472 is supplied (i.e., where the bending of the cleaning blade 465 is less likely to occur). The distances from the cutaway concave portion 770*b* and the cutaway end portions 770*d* to the cleaning blade 465 to the cleaning blade 465 are relatively large, and therefore the supplying amount of the waste toner 472 is restricted.

Figure 19:
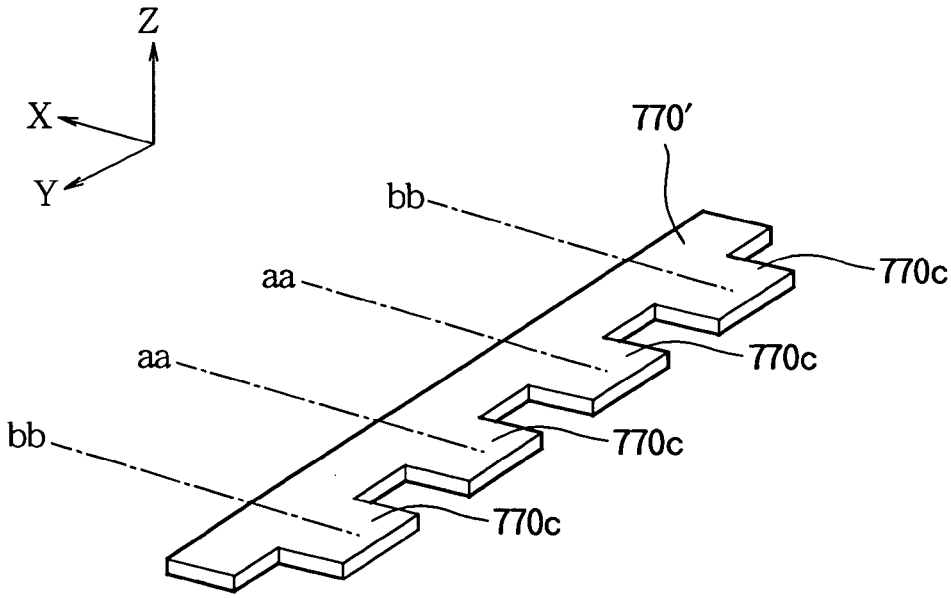
FIG. 19 is a perspective view showing an external form of a modification of the toner accumulation member according to Embodiment 3.

FIG. 19 is a plan view showing a modification of the toner accumulation member according to Embodiment 3 of the present invention.

In the case where various kinds of recording sheets are used, it is also possible to use a toner accumulation member 770' shown in FIG. 19. The toner accumulation member 770' of FIG. 19 has convex portions 770*c* formed on both sides of the center of the toner accumulation member 770' in the width direction. Centers of respective convex portions 770*c* are substantially aligned with centers (for example, centers "aa" and "bb") of ends of a plurality of kinds of recording sheets in the width direction. With such a configuration, suitable amount of waste toner 472 is supplied to the contact portion between the cleaning blade 465 and the transfer belt 461 at portions corresponding to the end portions of the respective recording sheets in the width direction. In the example shown in FIG. 19, convex portions 770*c* are formed corresponding to the end portions of two kinds of recording sheets 101*a* and 101*b* in the width direction.

The shape of the toner accumulation member 770' of Embodiment 3 can be combined with the shape of the toner accumulation member 670 of Embodiment 2 capable of supplying the waste toner to both end portions of the cleaning blade 465 in the longitudinal direction of the cleaning blade 465. With such a combination, the bending of the cleaning blade 465 at portions corresponding to the end portions of the recording sheet 101 (in the width direction of the recording sheet 101) can be prevented, and the bending of the end portions of the cleaning blade 465 (in the longitudinal direction of the cleaning blade 465) can also be prevented.

As described above, according to the image forming apparatus of Embodiment 3, it becomes possible to supply suitable amount of waste toner to portions of the cleaning blade corresponding to both end portions of the recording sheet where the supply of toner adhering to the surface of the transfer belt is insufficient. Further, it becomes possible to prevent excessive supply of waste toner to the center portion of the cleaning blade where a sufficient amount of toner is supplied (i.e., where the bending is less likely to occur). Therefore, the waste toner is supplied in a balanced manner, with the result that it becomes possible to prevent the deterioration in cleaning performance at the center portion of the cleaning blade do to the passing-through of the waste toner, and to prevent the bending of the cleaning blade at both end portions of the cleaning blade in the width direction of the recording sheet.

Embodiment 4

Figure 20:
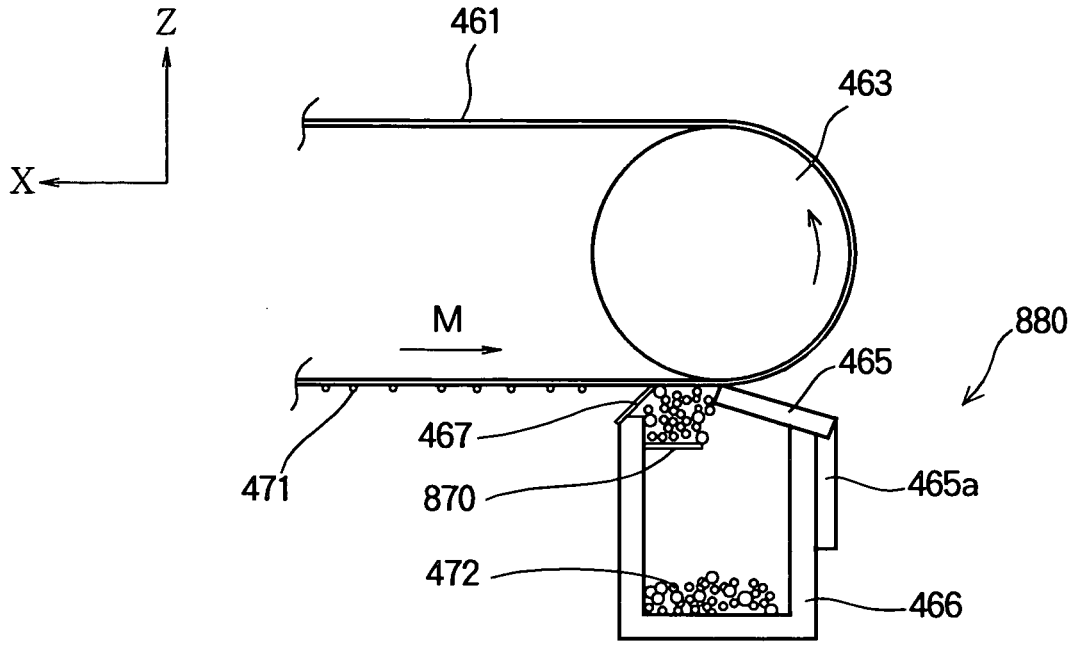
FIG. 20 is an enlarged view showing a cleaning apparatus including a cleaning blade and a toner box according to Embodiment 4 and surroundings thereof.

FIG. 20 is an enlarged view showing a cleaning apparatus 880 having a cleaning blade 465 and a toner box 466 of an image forming apparatus of Embodiment 4 of the present invention and surroundings thereof.

The difference between the image forming apparatus having the cleaning apparatus 880 of Embodiment 4 and the image forming apparatus having the cleaning apparatus 480 (FIG. 2) of Embodiment 1 is in the shape of the toner accumulation member 870. Therefore, components of the image forming apparatus (having the cleaning apparatus 880) of Embodiment 4 which are the same as those of the image forming apparatus 1000 of Embodiment 1 are assigned the same reference numerals or omitted in drawings, and duplicate descriptions thereof are omitted. The description is emphasized on the difference between the image forming apparatus of Embodiment 4 and the image forming apparatus of Embodiment 1. The components of the image forming apparatus of Embodiment 4 except the toner accumulation member 870 are the same as those of the image forming apparatus 1000 of Embodiment 1, and therefore FIG. 1 is referred as necessary.

The toner accumulation member 870 of Embodiment 4 is formed of a resilient member such as, for example, Mylar (trademark) film made of PET (Poly Ethylene Terephthalate). An end of the toner accumulation member 870 is fixed to a predetermined position inside the toner box 466 using, for example, a double-sided adhesion tape or the like. The fixing position and the shape of the toner accumulation member 870 are determined in accordance with the space S and the distances A and B presenting the fixing position and the shape of the toner accumulation member 770 having been described with reference to FIG. 18 in Embodiment 3.

The toner accumulation member 870 is configured so that the deflection amount thereof increases and the space S is enlarged according to the amount of the waste toner 472 accumulated on the toner accumulation member 870. The operation of the above configured cleaning apparatus 880 will be described.

The driving roller 462 is rotated counterclockwise as shown by an arrow in FIG. 1, and the transfer belt 462 moves in a direction shown by an arrow M in FIG. 20. The toner 471 remaining on the photosensitive drum 431 without being transferred to the recording sheet 101 adheres to the surface of the transfer belt 461 moving in the direction indicated by the arrow M. As shown in FIG. 20, when the transfer belt 461 moves, the toner 471 adhering to the surface of the transfer belt 461 is scraped off at the contact portion between the transfer belt 461 and the cleaning blade 465, and the scraped-off toner 471 (i.e., waste toner 472) is stored in the toner box 466.

A part of the waste toner 472 scraped off from the surface of the transfer belt 461 by the cleaning blade 465 is accumulated on the toner accumulation member 870. The waste toner 472 is accumulated until the waste toner 472 reaches the surface of the transfer belt 461 and the tip of the cleaning blade 465. The waste toner 472 accumulated exceeding a predetermined amount on the toner accumulation member 870 falls from the toner accumulation member 870 through the space S, and is stored in the toner box 466.

The waste toner 472 accumulated on the toner accumulation member 870 contacts and adheres to the transfer belt 461 and the cleaning blade 465, and is supplied to the contact portion between the transfer belt 461 and the cleaning blade 465 as lubricant.

Here, in the case where a flowability of the waste toner 472 decreases due to environmental changes or the like, the waste toner 472 accumulated on the toner accumulation member 870 becomes less movable into the inside of the toner box 466 via the space S. Therefore, the waste toner 472 tends to be excessively accumulated on the toner accumulation member 870. If the toner accumulation member 870 has no resiliency, the excessively accumulated waste toner 472 causes an excessively large pressure applied to the cleaning blade 475, which may cause the passing-through of the waste toner 472.

Figure 21:
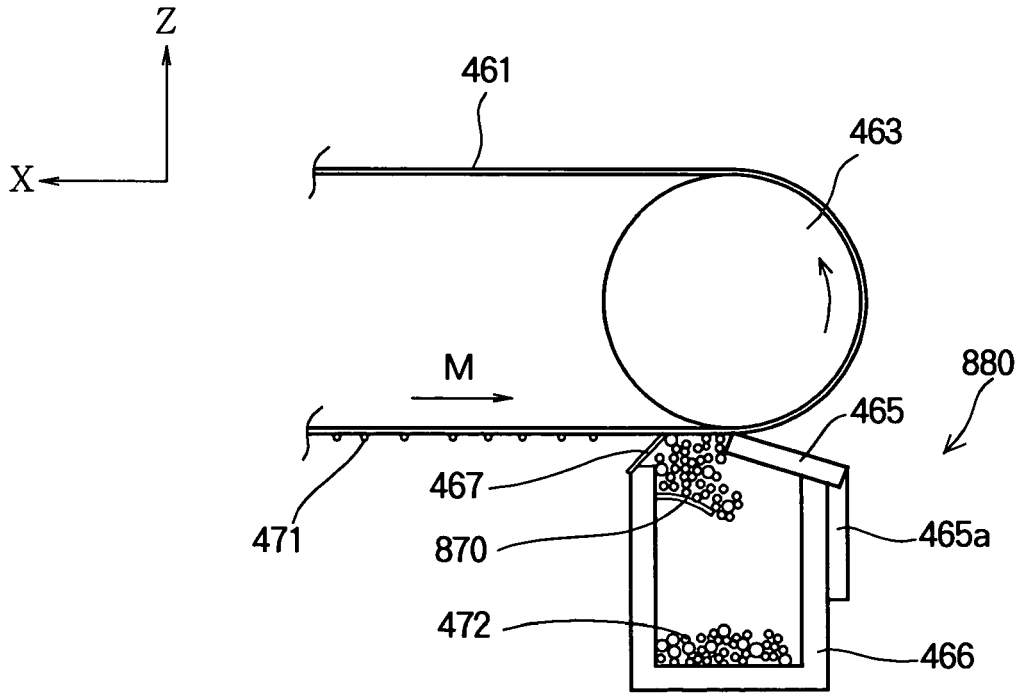
FIG. 21 is a view for illustrating an operation of an image forming apparatus according to Embodiment 4.

In contrast, the toner accumulation member 870 of Embodiment 4 is formed of a resilient member such as Mylar film. Therefore, when a large amount of the waste toner 472 is accumulated on the toner accumulation member 870 to start applying a pressure to the cleaning blade 465, the toner accumulation member 870 deflects as shown in FIG. 21 due to a reaction force from the cleaning blade 465 and due to the weight of the waste toner 472. Accordingly, the pressure applied to the cleaning blade 465 decreases, and the passing-through of the waste toner 472 due to the excessive accumulation can be prevented.

Further, since the space S is enlarged by the deflection of the toner accumulation member 870, the waste toner 472 is more likely to fall in the toner box 466. Therefore, the exceedingly accumulated waste toner 472 falls in the toner box 466 and is stored therein. Therefore, the amount of the waste toner 472 accumulated on the toner accumulation member 870 can be restricted within a suitable range, and suitable amount of waste toner 472 is supplied to the contact portion between the cleaning blade 465 and the transfer belt 461.

As described above, according to the image forming apparatus of Embodiment 4, the toner accumulation member 870 is formed of a resilient member such as Mylar film. Therefore, even when the amount of the waste toner 472 accumulated on the toner accumulation member 870 increases, the pressure applied to the cleaning blade 465 can be reduced, with the result that the passing-through of the waste toner 472 due to the excessive accumulation of the waste toner 472 can be prevented. Moreover, since a suitable amount of waste toner 472 is supplied to the contact portion between the cleaning blade 465 and the transfer belt 461, the bending of the cleaning blade 465 can be prevented.

Embodiment 5

Figure 22:
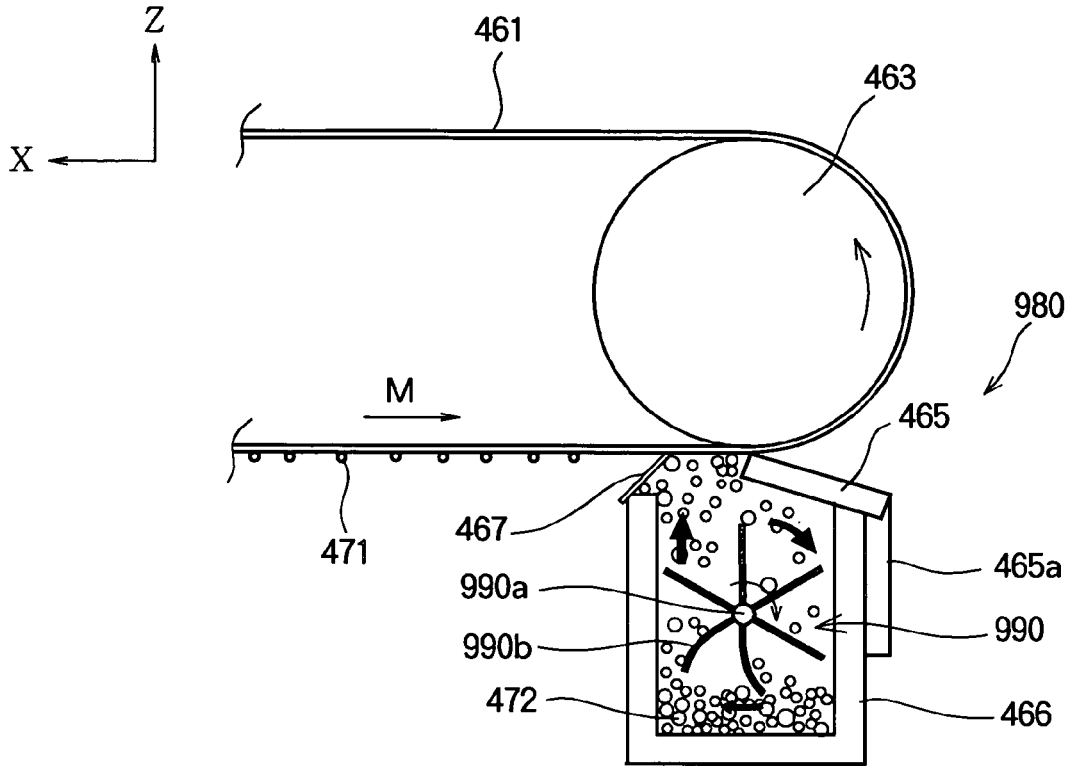
FIG. 22 is an enlarged view showing a cleaning apparatus including a cleaning blade and a toner box according to Embodiment 5 and surroundings thereof.

FIG. 22 is an enlarged view showing a cleaning apparatus 980 having a cleaning blade 465 and a toner box 466 of an image forming apparatus of Embodiment 5 of the present invention and surroundings thereof.

The image forming apparatus having the cleaning apparatus 980 of Embodiment 5 is different from the image forming apparatus having the cleaning apparatus 480 (FIG. 2) of Embodiment 1 is that an agitating apparatus 990 (as lubricant supply portion) is provided instead of the toner accumulation member 470. Therefore, components of the image forming apparatus (having the cleaning apparatus 980) of Embodiment 5 which are the same as those of the image forming apparatus 1000 of Embodiment 1 are assigned the same reference numerals or omitted in drawings, and duplicate descriptions thereof are omitted. The description is emphasized on the difference between the image forming apparatus of Embodiment 5 and the image forming apparatus of Embodiment 1. The components of the image forming apparatus of Embodiment 5 except the agitating apparatus 990 are the same as those of the image forming apparatus 1000 of Embodiment 1, and therefore FIG. 1 is referred as necessary.

The cleaning apparatus 980 of Embodiment 5 is configured to have the agitating apparatus 990 in the toner box 466 as shown in FIG. 22. The agitating apparatus 990 includes a shaft 990*a* extending in the direction of the toner box 466 (i.e., the Y direction) and rotated by a not shown driving unit, and a plurality of agitation films 990*b* elongated in the Y direction. One of longitudinal sides of each agitation film 990*b* is fixed to the shaft 990*a*. When the shaft 990*a* rotates clockwise in the direction shown by an arrow in FIG. 22, the respective agitation films 990*b* agitate the waste toner 472 stored in the toner box 466 and stir up the waste toner 472.

In the example shown in FIG. 22, a plurality of agitation films 990*b* are fixed to the shaft 990*a*, in order to efficiently agitate the waste toner 472 in a large toner box 466. However, in the case where the toner box 466 is small, the agitating apparatus 990 is able to efficiently agitate the waste toner 472 even when only one agitation film 990*b* is fixed to the shaft 990*a*.

As described above, according to the image forming apparatus of Embodiment 5, a part of the waste toner 472 stirred up by the agitating apparatus 990 is supplied to the contact portion between the cleaning blade 465 and the transfer belt 461 as lubricant. Therefore, it becomes possible to prevent the increase of the friction between the transfer belt 461 and the cleaning blade 465, and to prevent the bending of the cleaning blade 465. As a result, it becomes possible to prevent a deterioration of cleaning performance for removing the toner 471 (FIG. 2) from the transfer belt 461.

Figure 23:
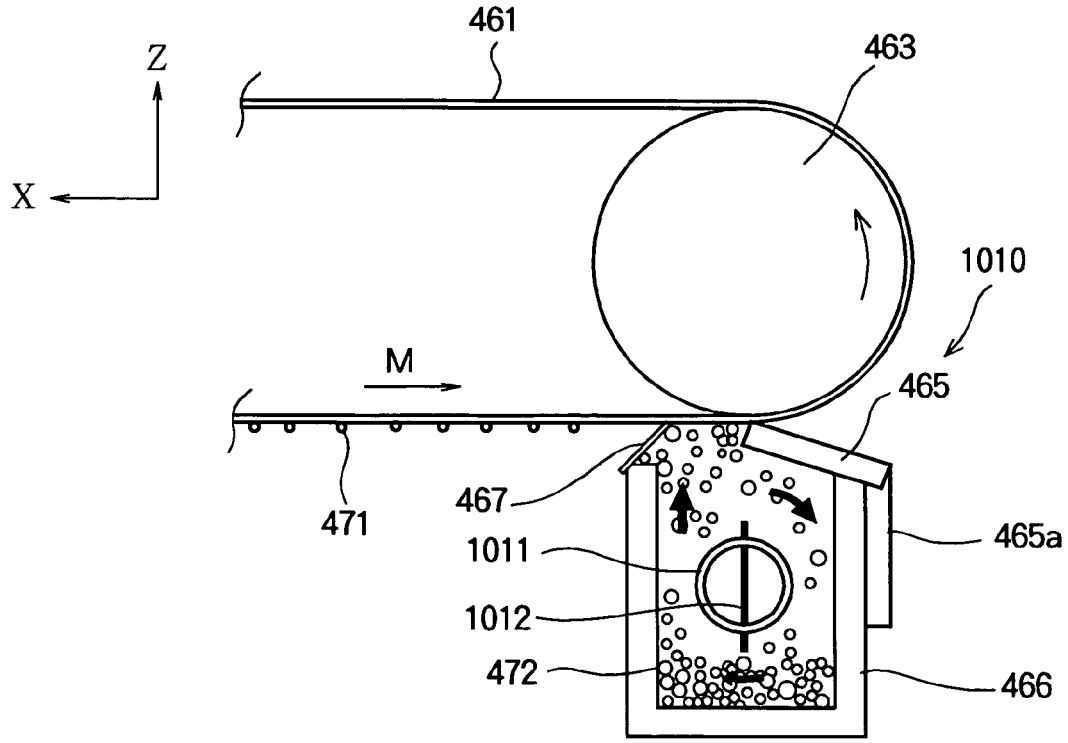
FIG. 23 is an enlarged view showing a modification of the cleaning apparatus according to Embodiment 5 and surroundings thereof.
Figure 24:
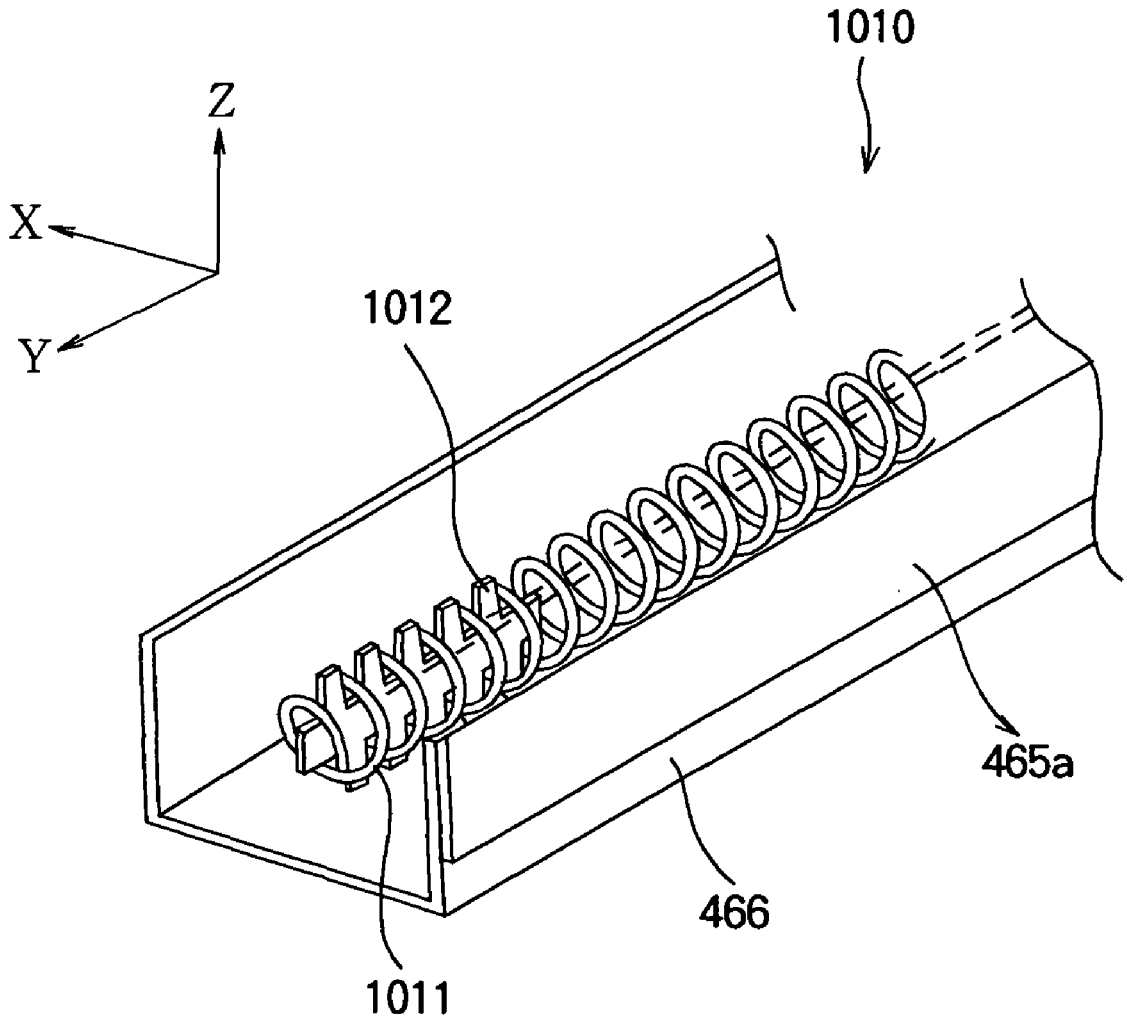
FIG. 24 is a perspective view showing an internal structure of the modification of the cleaning apparatus according to Embodiment 5.

FIG. 23 is an enlarged view showing a modification of the cleaning apparatus 1010 according to Embodiment 5 and surroundings thereof. FIG. 24 is an enlarged view showing an internal configuration of the cleaning apparatus 1010. In FIG. 24, a contour of the cleaning blade 465 is shown by a dashed line for the sake of simplicity.

In the above described cleaning apparatus 980 shown in FIG. 22, the shaft 990*a* to which the agitation films 990*b* are fixed is rotated so as to supply the waste toner 472 in the toner box 466 to the transfer belt 461 and the cleaning blade 465. However, it is also possible to obtain the same effect by mounting agitation film 1012 on a spiral (i.e., a spring) 1011 for conveying the waste toner 472 as shown in FIGS. 23 and 24.

In this case, the spiral 1011 driven by an external driving means (not shown) causes the waste toner 472 accumulated in the toner box 466 to move in a predetermined direction. When the waste toner 472 moved by the spiral 1011 and accumulated contacts the agitating film 1012, the agitating film 1012 fixed to the spiral 1011 and rotating together with the spiral film 1011 supplies the waste toner 472 to the transfer belt 461 and the cleaning blade 465.

The above described agitation film 1012 can be disposed at a position so as to supply the waste toner 472 to a desired position of the cleaning blade 465. In other words, the agitation film 1012 can be configured to supply the waste toner 472 to the entire area of the transfer belt 461 as described in Embodiment 1, or can be configured to supply the waste toner 472 to predetermined portion(s) of the transfer belt 461 in the Y-direction as described in Embodiments 2 through 4.

The embodiments are described with reference to an example in which the present invention is used to clean the transfer belt in the color electrophotographic printer, but the present invention is also applicable to, for example, an apparatus for cleaning the residual toner on the image bearing body using the cleaning blade.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

a belt conveying portion having a movable endless belt provided around at least two supporting members;

a cleaning member provided in contact with a surface of said belt;

a lubricant supply portion provided below a contact portion between said belt and said cleaning member, said lubricant supply portion supplying lubricant to said contact portion; and an adhered-material storing portion provided below said lubricant supply portion, said adhered-material storing portion storing adhered-material scraped off from said belt by said cleaning member;

said lubricant supply portion including an accumulation member provided between said cleaning member and said adhered-material storing portion;

said accumulation member being configured to hold a predetermined amount of the adhered-material, and an amount of the adhered-material that exceeds the predetermined amount being released to said adhered-material storing portion;

the adhered-material held on said accumulation member being supplied to said belt as the lubricant;

said accumulation member having a plate shape extending substantially parallel with said belt from a wall of said adhered-material storing portion, said wall being disposed on an upstream side of said adhered-material storing portion in a conveying direction of said belt; and a region being formed between said accumulation member and said belt, the adhered-material scraped off by said cleaning member being held in said region.

2. The image forming apparatus according to claim 1, wherein the lubricant is accumulated on said accumulation member.

3. The image forming apparatus according to claim 2, wherein said lubricant supply portion includes a shelf-like member.

4. The image forming apparatus according to claim 3, wherein said lubricant accumulation member is provided substantially parallel to a surface of said belt, and extends in a width direction of said belt.

5. The image forming apparatus according to claim 4, wherein said lubricant accumulation member is disposed at one of:

a position at a distance from 3.0 mm to 8.0 mm below said contact portion and at a distance from 2.0 mm to 3.0 mm upstream of said contact portion in a moving direction of said belt, a position at a distance from 5.0 mm to 9.0 mm below said contact portion and at a distance from 0.0 mm to 1.0 mm upstream of said contact portion in said moving direction of said belt, and a position at a distance of 10.0 mm below said contact portion and at a distance of 0.0 mm upstream of said contact portion in said moving direction of said belt.

6. The image forming apparatus according to claim 4, wherein a dimension of said lubricant accumulation member in a moving direction of said belt is longer at an end portion than at a center portion in the width direction of said endless belt.

7. The image forming apparatus according to claim 4, wherein a dimension of said lubricant accumulation member in a moving direction of said belt is longer at a portion corresponding to an end portion of a recording medium which said image forming apparatus is able to convey than at a portion other than the portion corresponding to the end portion of the recording medium in the width direction of said belt.

8. The image forming apparatus according to claim 3, wherein said lubricant accumulation member is formed of a resilient member.

9. The image forming apparatus according to claim 2, wherein said lubricant accumulation member is disposed in said adhered-material storing portion.

10. The image forming apparatus according to claim 1, wherein said lubricant supply portion includes an agitating member disposed in said adhered-material storing portion, the agitating member agitating said adhered-material.

11. The image forming apparatus according to claim 1, wherein the adhered-material is a toner.

12. The image forming apparatus according to claim 11, wherein said adhered-material storing portion stores the toner scraped off by said cleaning member.

13. The image forming apparatus according to claim 1, wherein the lubricant is a powder material.

14. The image forming apparatus according to claim 13, wherein the powder material is a toner.

15. The image forming apparatus according to claim 14, wherein the toner is a toner scraped off from said belt.

16. The image forming apparatus according to claim 1, wherein said belt is a transfer belt for transferring a toner image to a recording medium from an image bearing body provided in opposition to said transfer belt.

17. The image forming apparatus according to claim 1, wherein said cleaning member and said lubricant supply portion are disposed so as to form a predetermined gap therebetween.

18. The image forming apparatus according to claim 17, wherein the adhered-material scraped off from said endless belt is partially stored into said adhered-material storing portion via the gap, and is partially accumulated on said lubricant supply portion.

19. An image forming apparatus comprising:

a toner adhesion member to which a toner adheres, said toner adhesion member causing the toner to move;

a cleaning member provided in contact with a surface of said toner adhesion member;

a toner accumulation member disposed below a contact portion between said toner adhesion member and said cleaning member so that a part of the toner scraped off by said cleaning member is accumulated on said toner accumulation member;

a toner storing portion provided below said toner accumulation member, said toner storing portion storing the toner scraped off by said cleaning member; and a belt conveying portion having a movable endless belt;

the toner accumulated on said toner accumulation member being supplied to said contact portion as lubricant;

said toner accumulation member being provided between said cleaning member and an adhered-material storing portion;

said toner accumulation member being configured to hold a predetermined amount of adhered-material scraped off by said cleaning member, and an amount of the adhered-material that exceeds the predetermined amount being released to said adhered-material storing portion;

the adhered-material held on said accumulation member being supplied as lubricant;

said toner accumulation member having a plate shape extending substantially parallel with said belt from a wall of said toner storing portion, said wall being disposed on an upstream side of said toner storing portion in a conveying direction of said belt; and a region being formed between said toner accumulation member and said belt, the toner scraped off by said cleaning member being held in said region.

20. The image forming apparatus according to claim 19, wherein said cleaning member and said toner accumulation member are disposed so as to form a predetermined gap therebetween.

21. The image forming apparatus according to claim 20, wherein the toner scraped off from said toner adhesion member is partially stored into said toner storing portion via the gap, and is partially accumulated on said toner accumulation member.

22. A belt conveying apparatus for conveying a recording medium, said belt conveying apparatus comprising:

a belt conveying portion having a movable endless belt provided around at least two supporting members;

a cleaning member provided in contact with a surface of said belt;

a lubricant supply portion provided below a contact portion between said belt and said cleaning member, said lubricant supply portion supplying lubricant to said contact portion; and an adhered-material storing portion provided below said lubricant supply portion, said adhered-material storing portion storing adhered-material scraped off from said belt by said cleaning member;

said lubricant supply portion including an accumulation member provided between said cleaning member and said adhered-material storing portion;

said accumulation member being configured to hold a predetermined amount of the adhered-material, and an amount of the adhered-material that exceeds the predetermined amount being released to said adhered-material storing portion;

the adhered-material held on said accumulation member being supplied to said belt as the lubricant;

said accumulation member having a plate shape extending substantially parallel with said belt from a wall of said adhered-material storing portion, said wall being disposed on an upstream side of said adhered-material storing portion in a conveying direction of said belt; and a region being formed between said accumulation member and said belt, the adhered-material scraped off by said cleaning member being held in said region.

23. The belt conveying apparatus according to claim 22, wherein said cleaning member and said lubricant supply portion are disposed so as to form a predetermined gap therebetween.

24. The belt conveying apparatus according to claim 23, wherein the adhered-material scraped off from said endless belt is partially stored into said adhered-material storing portion via the gap, and is partially accumulated on said lubricant supply portion.

* * * * *